US006685444B2

(12) United States Patent
Ogawa

(10) Patent No.: US 6,685,444 B2
(45) Date of Patent: Feb. 3, 2004

(54) FLUID DISCHARGING DEVICE WITH A RECIPROCATING PUMP MEMBER DEFINING AN OUTLET VALVE, AND A VALVE MEMBER DEFINING AN OUTLET AND SUCTION VALVE

(75) Inventor: Kenji Ogawa, Musashino (JP)

(73) Assignee: Neuberg Company Limited, Tokyo (JP)

( * ) Notice: Subject to any disclaimer, the term of this patent is extended or adjusted under 35 U.S.C. 154(b) by 0 days.

(21) Appl. No.: 10/174,943

(22) Filed: Jun. 20, 2002

(65) Prior Publication Data

US 2002/0197173 A1 Dec. 26, 2002

(30) Foreign Application Priority Data

Jun. 22, 2001 (JP) ..... 2001-189603

(51) Int. Cl.[7] ..... F04B 17/06

(52) U.S. Cl. ..... 417/413.1; 417/479; 417/480; 222/504; 92/62

(58) Field of Search ..... 417/413.1, 413.2, 417/479, 480; 222/504; 92/62, 48, 50

(56) References Cited

U.S. PATENT DOCUMENTS 3,948,589 A * 4/1976 DuBois ..... 417/487
5,462,199 A * 10/1995 Lenhardt ..... 222/54
5,467,899 A * 11/1995 Miller ..... 222/309
5,503,538 A * 4/1996 Wiernicki et al. ..... 417/560
6,261,066 B1 * 7/2001 Linnemann et al. ..... 417/53
6,280,148 B1 * 8/2001 Zengerle et al. ..... 417/44.1
6,390,791 B1 * 5/2002 Maillefer et al. ..... 417/413.3
6,395,638 B1 * 5/2002 Linnemann et al. ..... 438/706
6,554,587 B2 * 4/2003 Paolini et al. ..... 417/413.1
2002/0114716 A1 * 8/2002 Takagi et al. ..... 417/413.2

OTHER PUBLICATIONS

Patent Abstracts of Japan, Publication No. 02–055878, Publication Date Feb. 26, 1990.
Patent Abstracts of Japan, Publication No. 02–230975, Publication Date Sep. 13, 1990.
Patent Abstracts of Japan, Publication No. 07–035046, Publication Date Feb. 3, 1995.

* cited by examiner

*Primary Examiner*—Justine R. Yu
*Assistant Examiner*—Emmanuel Sayoc
(74) *Attorney, Agent, or Firm*—Lowe Hauptman Gilman & Berner LLP

(57) ABSTRACT

A fluid discharging device is provided with diaphragm members 20 and 30. The diaphragm member 30 being a valve member comprises an outlet 35 and a suction passage opening and closing portion 33, and can be moved forward and backward relative to the diaphragm member 20 being a pump member. The diaphragm member 20 comprises an outlet opening and closing portion 25 capable of opening and closing the outlet 35 and a measuring portion 26 capable of changing the volume of a measuring space 42. An outlet opening and closing means 50 opens and closes the outlet 35 by moving the outlet opening and closing portion 25 backward and forward relative to the outlet 35, and opens a liquid suction passage 40 by detaching the suction passage opening and closing portion 33 from the diaphragm member 20. A diaphragm moving means 55 changes the volume of the measuring space 42 by moving the measuring portion 26 forward and backward. The diaphragm member 30 closes the liquid suction passage 40 by pressing the suction passage opening and closing portion 33 against the diaphragm member 20 by its own elasticity.

5 Claims, 13 Drawing Sheets

FLUID DISCHARGING DEVICE WITH A RECIPROCATING PUMP MEMBER DEFINING AN OUTLET VALVE, AND A VALVE MEMBER DEFINING AN OUTLET AND SUCTION VALVE

BACKGROUND OF THE INVENTION

1. Field of the Invention

The present invention relates to a fluid discharging device for sucking, measuring and discharging a fluid such as a liquid, gas and the like, and can be utilized particularly in a dispenser for repeatedly discharging each constant amount of fluid or in a pump for continuously feeding a fluid.

2. Description of the Related Art

Up to now, devices in various forms are known as a fluid discharging device (pump or dispenser), and the present applicant has proposed pumps of a plunger type disclosed in Japanese Patent Laid-Open Publication No. Hei 2-55,878 and Japanese Patent Laid-Open Publication No. Hei 2-230, 975, and a diaphragm pump disclosed in Japanese Patent Laid-Open Publication No. Hei 7-35,046 as a pump capable of discharging even a very small amount of fluid with high accuracy.

These fluid discharging devices each comprise a suction passage opening and closing valve for opening and closing a suction passage to suck a fluid, an outlet opening and closing valve for opening and closing an outlet to discharge the fluid and a discharging member for discharging the fluid, arrange the outlet opening and closing valve, the discharging member and the suction passage opening and closing valve in the shape of concentric circles in the order of the outlet opening and closing valve, the discharging member and the suction passage opening and closing valve from the inside to the outside, and comprise a driving mechanism for driving the outlet opening and closing valve, the discharging member and the suction passage opening and closing valve so that they operate respectively in their specified action manners.

A sucking operation in these fluid discharging devices closes an outlet opening and closing valve, opens a suction passage opening and closing valve, moves a discharging member away from the outlet in this state, and makes a space formed between the outlet and the discharging member suck a fluid into it.

And a discharging operation of it closes the suction passage opening and closing valve after suction of a fluid and thereby measures a specified amount of liquid to be discharged, and thereafter opens the outlet opening and closing valve, moves the discharging member to the outlet side and discharges the fluid, and finally closes the outlet opening and closing valve to complete the discharging operation.

In such a way, since each of these fluid discharging devices is provided with a suction passage opening and closing valve and an outlet opening and closing valve, cuts off the communication between the suction passage and the outlet during the period from a fluid sucking operation to a discharging operation and performs a measuring operation for measuring an amount of liquid to be discharged, it can adjust even a very small amount of fluid to be discharged with high accuracy.

In these fluid discharging devices, however, since it is necessary to drive separately the respective suction passage opening and closing valve, outlet opening and closing valve and discharging member described above, it is necessary to provide three driving units. Due to this, there has been a problem that the inside structure of a fluid discharging device becomes so complicated that it is difficult to be made small-sized.

And these fluid discharging devices are utilized to discharge an extremely small amount of adhesive, drug and the like in a semiconductor production line and the like, and since it is possible to suppress the interval or space between a number of fluid discharging devices arranged in parallel to the minimum and improve the efficiency of production if a fluid discharging device itself can be made small-sized, it has been intensely desired to make a fluid discharging device small-sized.

SUMMARY OF THE INVENTION

An object of the present invention is to provide a fluid discharging device capable of discharging even a very small amount of fluid with high accuracy and being made simple in structure and small in size.

Another object of the present invention is to provide a fluid discharging device capable of preventing a fluid from leaking outside the fluid discharging device and capable of being manufactured in low cost even in case of making it chemical-resistant.

The present invention is characterized by a fluid discharging device comprising a pump member, a valve member, and a suction passage and an outlet capable of communicating with a measuring space to be closed by the pump member and the valve member, wherein;

said valve member is provided with said outlet and is provided so as to be movable forward and backward in the axial direction of the outlet relative to the pump member, and this valve member is provided with a suction passage opening and closing portion capable of closing or opening said suction passage by being attached to or detached from said pump member with the forward or backward movement of it, and said pump member is provided with an outlet opening and closing portion capable of closing or opening the outlet by being attached to or detached from the outlet of the valve member and a measuring portion which is arranged in the shape of a concentric circle outside this outlet opening and closing portion and is capable of changing the volume of a measuring space by being moved forward and backward relative to said measuring space; and said fluid discharging device is provided with;

an outlet opening and closing means which can close and open the outlet by moving said outlet opening and closing portion forward and backward relative to the outlet, and can open the suction passage by detaching the suction passage opening and closing portion of the valve member from the pump member through energizing said valve member toward the outlet, a measuring portion moving means which is arranged in the shape of a concentric circle outside the outlet opening and closing means and can change the volume of the measuring space by moving said measuring portion forward and backward relative to the valve member, an energizing means for closing the suction passage by pressing said suction passage opening and closing portion against the pump member through energizing said valve member toward the pump member, and a driving means for driving said outlet opening and closing means and said measuring portion moving means respectively in their specified action manners.

In such an invention as described above, since a valve member having an outlet formed in it which has not been moved hitherto is provided so as to be movable forward and backward in the axial direction of the outlet and this valve member is moved forward and backward by an energizing means and an outlet opening and closing means, the outlet opening and closing means for moving the outlet opening and closing portion can be also utilized for moving the suction passage opening and closing portion.

Due to this, while it is necessary to provide three driving units in the prior art, it is enough to provide only two driving units in the present invention and it is possible to make a fluid discharging device simple in structure and small in size.

Further, since it is provided with a suction passage opening and closing portion and an outlet opening and closing portion, it can perform a measuring operation for measuring an amount of liquid to be discharged by cutting off the communication between the suction passage and the outlet during the period from a fluid sucking operation to a discharging operation, and can discharge even a very small amount of fluid with high accuracy.

In the present invention, it is preferable that said pump member is formed out of a diaphragm being made into a thin film in the central side and being made thick in thickness in the peripheral side, an outlet opening and closing portion and a measuring portion formed on the circumference having this outlet opening and closing portion as its center are provided on the thin film part, and a flat seal portion against which the outlet opening and closing portion of said valve member is pressed is formed on said peripheral part made thick in thickness, an said valve member is formed into one body with a diaphragm being made into a thin film in its peripheral side and being made thick in its central side and is fixed immovably to said pump member in its peripheral part, and an outlet is formed in said thick part being continuous to this peripheral part through the thin film, and this thick part is made movably forward and backward relative to said pump member by the deformation of said thin film part.

Forming each of a pump member and a valve member out of a diaphragm makes unnecessary the hermetic sealing between movable members such as an outlet opening and closing means, a measuring portion moving means and the like, improves the hermetic-sealing ability and thereby prevents a liquid from leaking outside the fluid discharging device and reduces the number of members to be in contact with liquid and therefore leads to reduction in manufacturing cost in case of making the fluid discharging device chemical-resistant.

And since the arrangement of an outlet opening and closing portion, an outlet opening and closing means for moving a measuring portion and a measuring portion moving means in the shape of concentric circles makes uniform the displacement in movement of each part of a diaphragm from the central part and thereby stabilizes the operation of them and makes it possible to control the displacement with high accuracy, a high-accuracy discharge is made possible even in case of a very small amount of fluid to be discharged.

In the present invention, it is preferable that the outlet opening and closing portion of said pump member is made thicker in thickness than the other thin film part and said measuring portion is formed by bending the thin film part.

If the device is formed in such a way, when the outlet opening and closing portion and the measuring portion are moved by the respective opening and closing means and moving means, the other thin film parts are surely deformed and thereby the outlet opening and closing portion and the measuring portion can be separately and smoothly moved. Therefore, it is possible to stabilize the operations of the outlet opening and closing portion and the measuring portion and also improve a fluid discharging operation in accuracy.

In the present invention, it is preferable that the outlet opening and closing portion and the flat seal portion of said pump member, and the outlet opening and closing portion of said valve member and the opening end face part of the outlet against which said outlet opening and closing portion is pressed are finished by lapping.

Making each of these parts have a finished face by lapping makes it possible to secure a necessary and sufficient sealing ability only by pressing them against each other. Further, in the present invention since the contact face of each part is a flat seal, a lapping process can be performed low in cost and high in accuracy and a high-accuracy discharging operation can be performed even in case of a very small amount of fluid to be discharged.

In the present invention, it is preferable that said driving means is composed to drive said outlet opening and closing means and said diaphragm moving means so as to perform;

a sucking operation of, in a state where the outlet is closed by pressing said outlet opening and closing portion against the valve member, sucking fluid by opening the suction passage by detaching the suction passage opening and closing portion of the valve member from the pump member and making the measuring space larger in volume by moving the measuring portion of the pump member away from the valve member, a measuring operation of measuring the fluid to be discharged by, after this sucking operation, closing the suction passage through pressing the suction passage opening and closing portion of the valve member against the pump member, and a discharging operation of discharging the fluid by, after this measuring operation, opening the outlet by detaching the outlet opening and closing portion of the pump member from the outlet and moving the measuring portion of the pump member so as to become close to the valve member.

Such a driving means can be formed out of, for example, a piezoelectric device, a fluidic cylinder, a motor, a cam, a solenoid and the like.

DETAILED DESCRIPTION OF THE PREFERRED EMBODIMENTS

Figure 1:
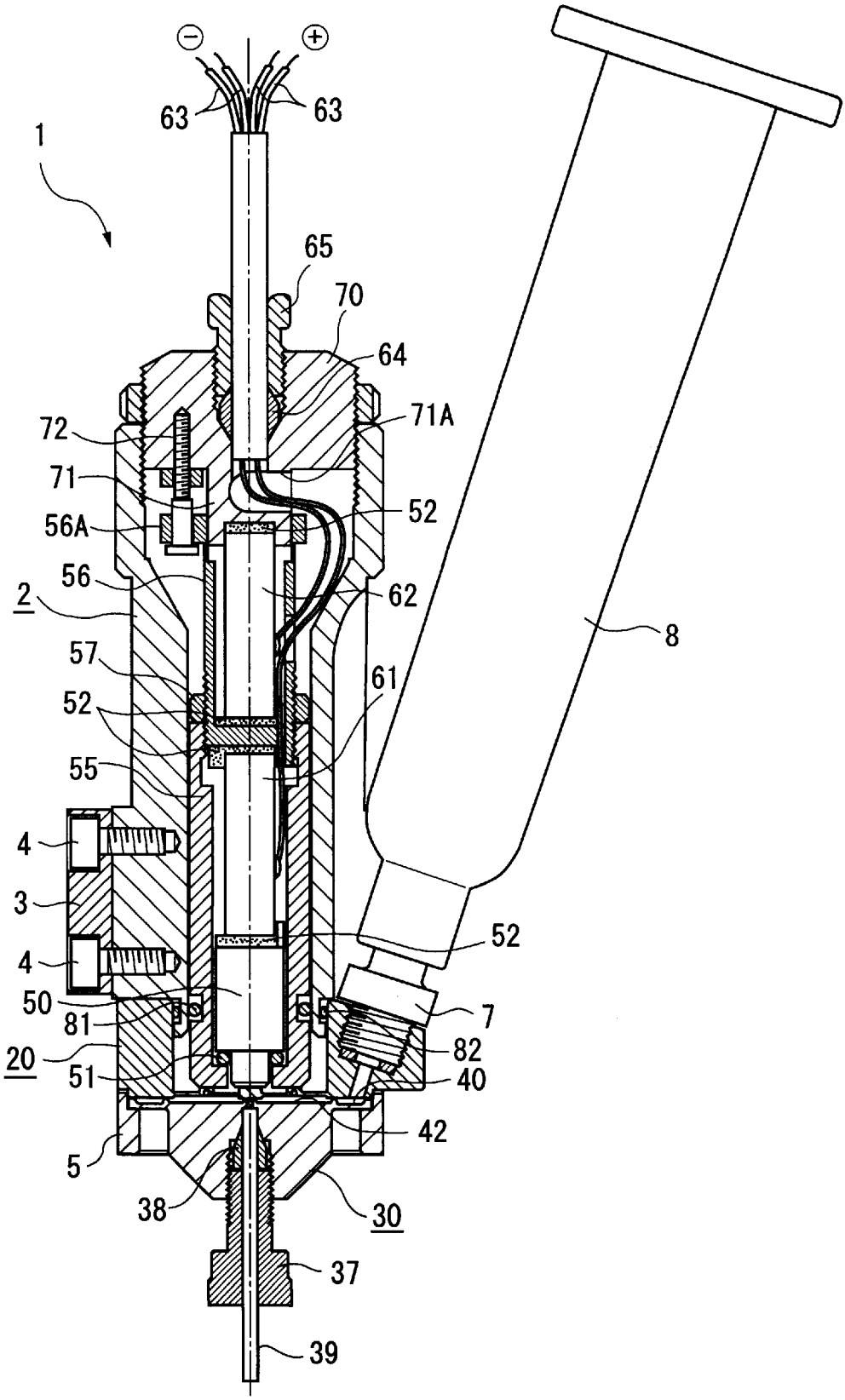
FIG. 1 is a vertical sectional view showing a first embodiment of the present invention.

Embodiments of the present invention are described with reference to the drawings in the following. For convenience of description, it is assumed that for example the upper side in FIG. 1 in a fluid discharging device 1 of a first embodiment shown in FIG. 1 is also the upper side of the fluid discharging device 1, and the lower side in FIG. 1 is also the lower side of the fluid discharging device 1. Therefore, FIG. 2 shows a top view of the fluid discharging device 1, and FIG. 3 shows a bottom view of the fluid discharging device 1.

First Embodiment

Figure 2:
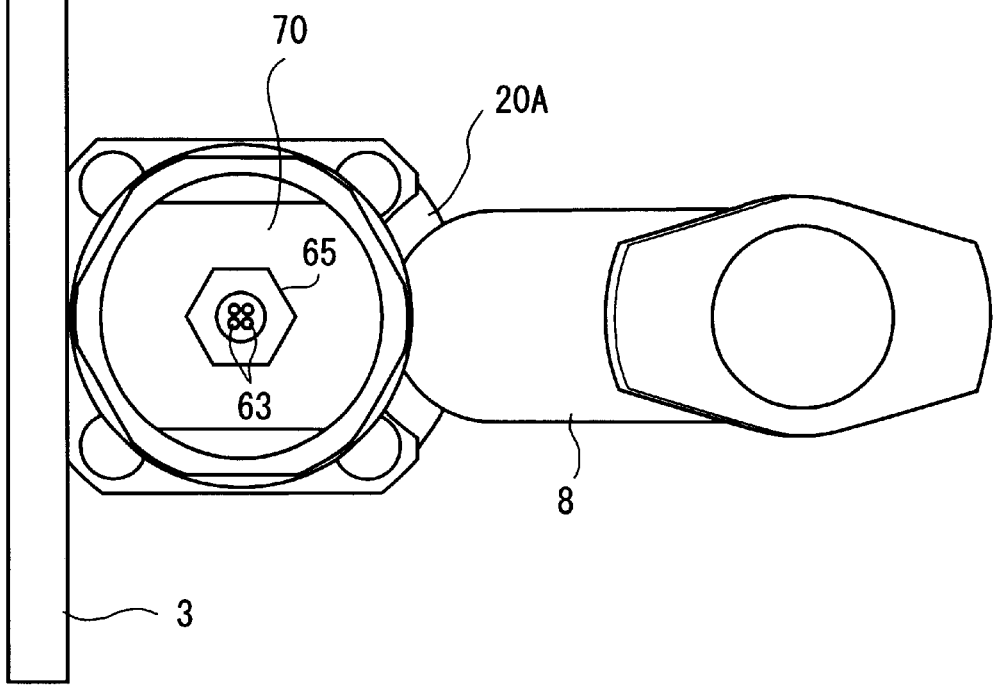
FIG. 2 is a top view of a fluid discharging device of said first embodiment.
Figure 3:
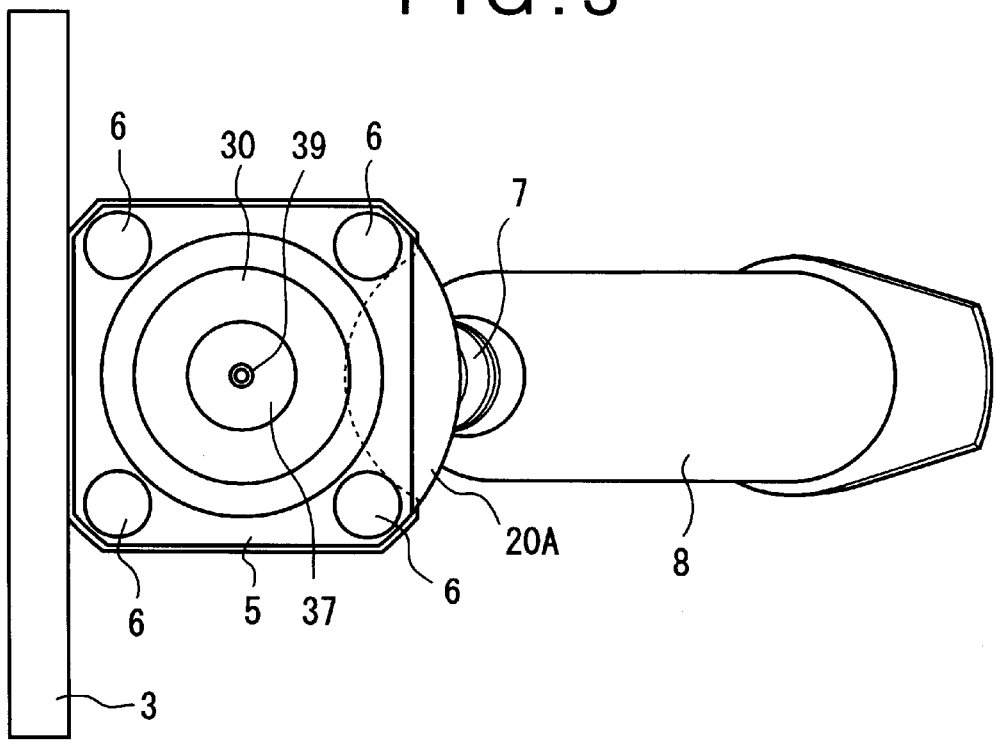
FIG. 3 is a bottom view of the fluid discharging device of said first embodiment.

As shown in FIGS. 1 to 3, a fluid discharging device 1 of a first embodiment is a diaphragm pump using a diaphragm in a pump part. And it uses a piezoelectric device (piezoelectric actuator) in a driving mechanism.

The fluid discharging device 1 is provided with a body 2, a diaphragm member 20 being connected to the lower end of the body 2 and acting as a pump member, and a diaphragm member 30 being arranged at the lower end of the diaphragm member 20 and acting as a valve member.

The body 2 is formed out of an alloy and the like being very small in thermal expansion coefficient (hardly expansible) approximately at the normal temperature such as an Invar alloy (iron-nickel alloy) and the like, the upper side of it is formed nearly in the shape of a cylinder, and its part to be fixed to a fixed part (a fixed plate 3 in FIG. 1) by screws 4 is formed in the shape of a square tube.

And each of the diaphragm members 20 and 30 is formed out of a metal material being elastic such as stainless steel, titanium, hastelloy and the like, is fixed being put between the body 2 and a fixing plate 5 in the shape of a square plate by bolts 6 to be screwed into the body 2 from the fixing plate 5.

Figure 4:
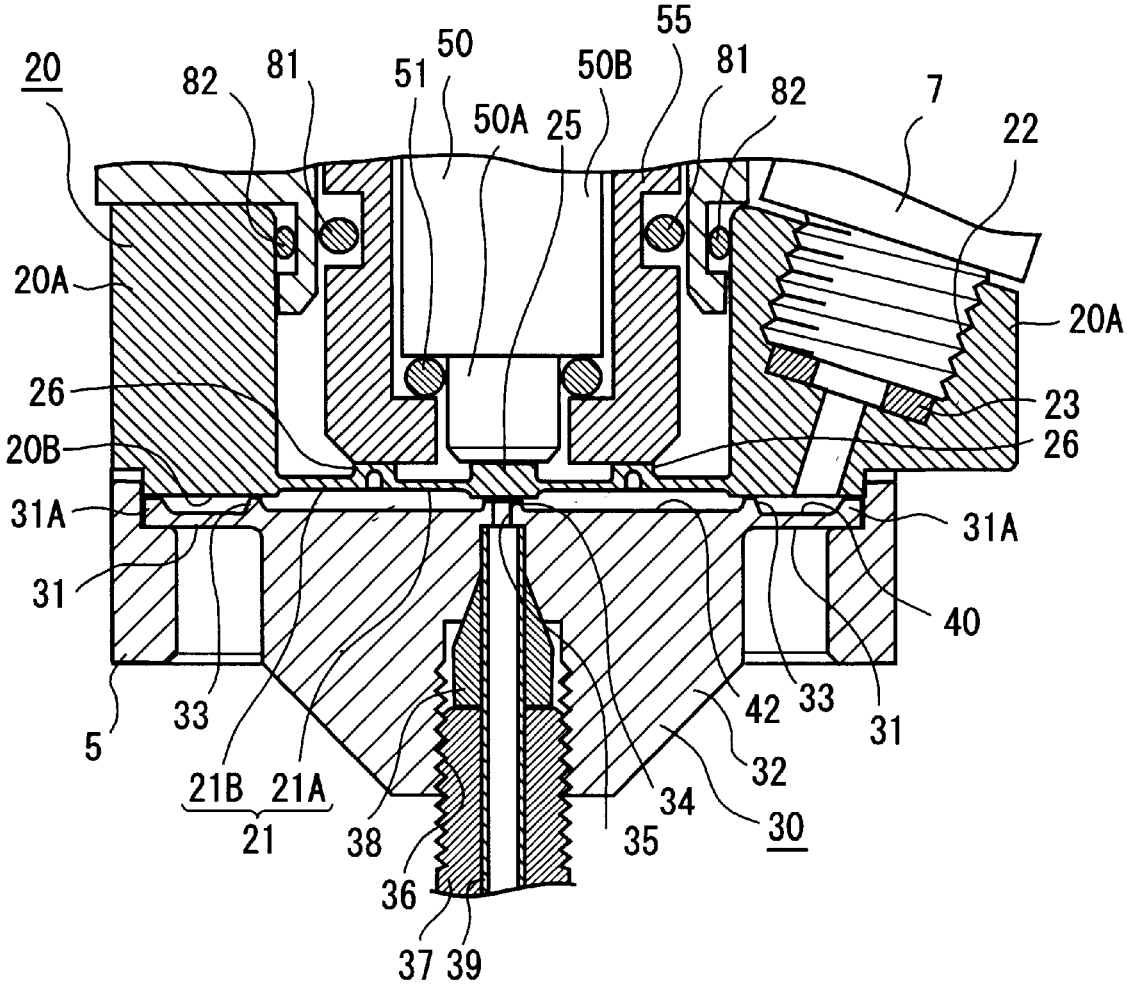
FIG. 4 is a sectional view showing a main part of said first embodiment.

As shown in FIG. 4 also, the diaphragm member 20 is made thick in its peripheral part 20A and is formed into a diaphragm portion 21 in the shape of a thin plate in its central axis part. And a part of a side face of it projects in the shape of a circular arc, and a suction port 22 having a liquid (fluid) fed to it is formed in the projected part. The suction port 22 has a connector 7 screwed into it through a resin seal member 23 in the shape of a ring. This connector 7 has a container 8 in the shape of a syringe connected to it, and a liquid is fed into the suction port 22 from the container 8 by feeding properly a pressurized air into the container 8.

A concave part in the shape of a circular arc is formed in the side face of the body 2 where the container 8 is disposed so that the container 8 does not interfere with the body 2.

As shown in FIG. 4 also, the central part of the diaphragm portion 21 of the diaphragm member 20 is made thicker in thickness in comparison with the other parts and has an outlet opening and closing portion 25 formed in it.

And around the outlet opening and closing portion 25, a measuring portion 26 formed by bending the diaphragm portion 21 in the shape of a rib is formed in the shape of a ring on the circumference having the outlet opening and closing portion 25 as its center.

And in the diaphragm part 21, a diaphragm part 21A from the outlet opening and closing portion 25 to the measuring portion 26 is made thinner in thickness than a diaphragm portion 21B from the measuring portion 26 to the peripheral part 20A being thick in thickness. Due to this, when a force is applied to the outlet opening and closing portion 25, the diaphragm portion 21A is bent before the diaphragm portion 21B is bent. For example, even in case that the diaphragm portion 21A is deformed by applying a force of several kilograms (several ten Ns), if this force is smaller than the initial pressure applied to the diaphragm portion 21B (for example ten and several kilograms (hundred and several ten Ns), only the diaphragm portion 21A is deformed.

Further, in the peripheral part 20A of the diaphragm member 20, the face at the diaphragm member 30 side is made to be a flat seal portion 20B finished by lapping.

The diaphragm member 30 has a diaphragm portion 31 formed in the peripheral part of it and its central part 32 is made thick in thickness. And the outermost peripheral edge of the diaphragm member 31 is made into a fixed portion 31A being thicker in comparison with the diaphragm portion 31, and this fixed portion 31A is held by said fixing plate 5. And a suction passage opening and closing portion 33 in the shape of a ring is projected toward the diaphragm member 20 side in the connection part of the diaphragm portion 31 with the central part 32. This suction passage opening and closing portion 33 is formed so as to be concentric with the measuring portion 26 and to be arranged at the outer peripheral side of the measuring portion 26.

The central part 32 of the diaphragm member 30 is projected from a circular opening formed in the middle of said fixing plate 5 toward the lower side of the fluid discharging device 1, and its lower part is formed nearly in the shape of a cone being made smaller in diameter as proceeding downward.

And a projecting portion 34 corresponding to the outlet opening and closing portion 25 of said diaphragm member 20 is formed at the center of the upper face of the central part 32, and the outlet 35 is formed downward the lower face of the central part 32 from this projecting portion 34.

The outlet 35 is in communication with an internal thread 36 formed in the lower part of the central part 32. This internal thread has a bolt 37 screwed into it. A discharging needle 39 is arranged so as to pass through this bolt 37 and a discharging needle fixing member 38 made of resin or the like. The discharging needle 39 is clamped and fixed by the discharging needle fixing member 38 through screwing the bolt 37 and pressing the tapered face of the discharging needle fixing member 38 against the tapered face of the outlet 35.

The central part 32 of the diaphragm member 30 can be moved forward and backward in the axial direction of the outlet 35, namely, in the vertical direction by an elastic force (spring force) of the diaphragm portion 31 relative to said fixing plate 5, namely, relative to the fixing portion 31A fixed by said fixing plate 5. And in a normal state (a state where an external force is not applied to the diaphragm member 30), the suction passage opening and closing portion 33 is arranged so that it is pressed against the flat seal portion 20B of said diaphragm member 20.

And a liquid suction passage 40 capable of communicating with the suction port 22 is defined and formed between the diaphragm member 20 and the diaphragm member 30. The liquid suction passage 40 is closed by pressing the suction passage opening and closing portion 33 against the flat seal portion 20B, and is opened by detaching the suction passage opening and closing portion 33 from the flat seal portion 20B. And a space defined inside the suction passage opening and closing portion 33 when the suction passage opening and closing portion 33 is pressed against the flat seal portion 20B to close the liquid suction passage 40 is defined as the measuring space 42, and said outlet 35 is made to be capable of communicating with this measuring space 42.

And the outlet opening and closing portion 25 and the flat seal portion 20B of the diaphragm member 20, and the suction passage opening and closing portion 33 and the projecting portion 34 of the diaphragm member 30 are made flat by lapping. In the initial state, since the outlet opening and closing portion 25 is different in height from the flat seal portion 20B, it is enough to perform a lapping finish after pressing the outlet opening and closing portion 25 by a specified pressure to coincide with the flat seal portion 20B in height.

On the other hand, a driving means for driving said diaphragm member 20 is arranged inside the body 2.

That is to say, as shown in FIG. 1, an outlet opening and closing means 50 being rod-shaped and a diaphragm moving means 55 being pipe-shaped which is arranged outside this outlet opening and closing means 50 are arranged in the shape of concentric circles inside the body 2.

An internal thread is formed in the inner circumferential face of the upper end portion of the diaphragm moving means 55 being a measuring portion moving means, and a connecting member 56 formed into the shape of a pipe is screwed into this internal thread. At this time, a nut 57 is screwed onto the connecting member 56, and a so-called double-nut function makes adjustable and fixable the screwed position of the connecting member 56 into the diaphragm moving means 55.

The upper end portion of the connecting member 56 is fitted onto the shaft part 71 of a lid member 70 so as to be movable in the axial direction of it. A top flange 56A of the connecting member 56 is penetrated by a bolt 72 screwed into the lid member 70. This bolt 72 helps making it easy to assemble the lid member 70, the connecting member 56 having piezoelectric devices 61 and 62 incorporated into it and the diaphragm moving means 55 into one body when assembling the fluid discharging device 1.

The outlet opening and closing means 50 arranged inside the diaphragm moving member 55 comprises a stepped rod and the bottom face of a small-diameter portion 50A of it is pressed against the top face of the outlet opening and closing portion 25. And a seal member 51 composed of an O-ring or the like is arranged at a step part between the small-diameter portion 50A and a large-diameter portion 50B and enhances the hermetic-sealing ability of the inside of the diaphragm moving means 55.

The first piezoelectric device 61 is arranged through resin sheets 52 between the top face of the outlet opening and closing means 50 and the bottom face of the connecting member 56. And the second piezoelectric device 62 is arranged through resin sheets 52 between the inner bottom face of the connecting member 56 and the bottom face of the shaft portion 71 of the lid member 70.

These piezoelectric devices 61 and 62 each are composed of piezoelectric elements of a laminated type and can be used as an actuator thanks to a fact that it is changed vertically in length by a specified voltage applied from a power source. For example, the displacement (change in length) of several $\mu$m to ten and several $\mu$m can be obtained by applying a specified driving voltage.

Due to this, two power cord 63 pairs, in which one cord and the other of each cord pair are connected respectively to the anode and the cathode of a power source, are respectively connected with the piezoelectric devices 61 and 62 so as to make it possible to apply a voltage individually to the piezoelectric devices 61 and 62 (there are 4 power cords 63 in total).

The power cords 63 are led into the body 2 through a through hole 71A formed in the shaft portion 71 from the top face of the lid member 70 and then are wired to the respective piezoelectric devices 61 and 62 through a wiring hole formed in the connecting member 56.

The power cords 63 are fixed to the lid member 70 by a bolt 65 screwed into a seal member 64 and the lid member 70 in a similar manner to the discharging needle 39.

In FIG. 1, the diaphragm moving means 55, the connecting member 56 and the lid member 70 disposed inside the body 2 are shown in a state where the two planes including the axis of the fluid discharging device 1 and being perpendicular to each other which planes cut the fluid discharging device 1 are unfolded into one plane. Due to this, for example, the through hole 71A passes through the shaft portion 71 in one direction, but the left side relative to the central axis in FIG. 1 is shown with a sectional view perpendicular to the axial direction of the through hole 71A and the right side is shown with a sectional view taken along the axial direction of the through hole 71A. Due to this, the diaphragm moving means 55, the connecting member 56, the lid member 70 and the like are seemingly asymmetrical but really symmetrical at the left and right sides with regard to the central axis in FIG. 1.

The lid member 70 is fixed by being screwed, namely, by a so-called double-nut function to the top opening of the body 2.

A seal member 81 composed of an O-ring or the like is arranged between the diaphragm moving means 55 and the body 2, and a seal member 82 composed of an O-ring or the like is arranged also between the body 2 and the diaphragm member 20, and thereby the inside of the body 2 is isolated from the open air and secured in air-tightness in order to prevent the piezoelectric devices 61 and 62 to be deteriorated in performance in high humidity from being deteriorated.

In this embodiment, a driving mechanism for driving the outlet opening and closing means 50 and the diaphragm moving means is composed of the piezoelectric devices 61 and 62, the connecting member 56 and a controller for controlling the piezoelectric devices 61 and 62. Particularly, the diaphragm moving means 55 is moved forward and backward through the connecting member 56 by the piezoelectric devices 61 and 62. And since the outlet opening and closing means 50 is moved basically by the piezoelectric device 61 but is moved also by the piezoelectric device 62, the driving mechanism for the outlet opening and closing means 50 is composed by including these.

And in this embodiment, since the suction passage opening and closing portion 33 is pressed against the flat seal portion 20B by a spring force of the diaphragm member 30 itself, an energizing means for energizing the suction passage opening and closing portion 33 to close the liquid suction passage 40 is composed of the diaphragm member 30.

Such operation of this embodiment is described with reference to an operation explaining diagram of FIG. 5.

Figure 5A:
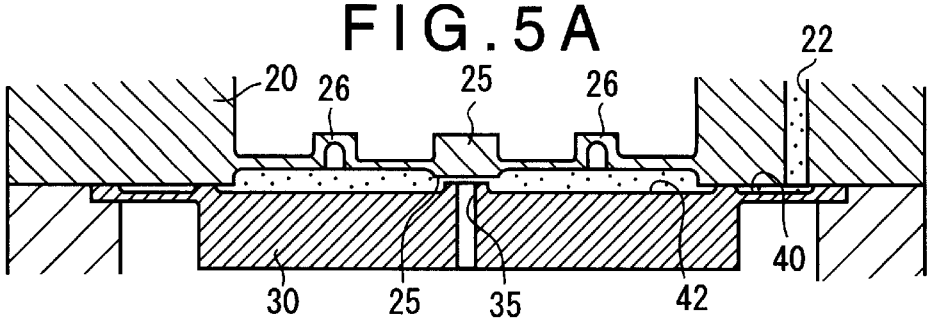
FIGS. 5A to 5E are diagrams for explaining the fluid discharging operation of said first embodiment.

Before the start of operation, namely, in a state where the fluid discharging device is at a stop, no voltage is applied to the piezoelectric devices 61 and 62. Due to this, the piezoelectric devices 61 and 62 are kept lowest in height. Therefore, the outlet opening and closing means 50 which moves downward when the piezoelectric device 61 extends and the diaphragm moving means 55 which moves downward when the piezoelectric device 62 extends are positioned respectively at the upper stroke end positions of them. Accordingly, the outlet opening and closing portion 25 and the measuring portion 26 of the diaphragm member 20 to be pressed against the outlet opening and closing means 50 and the diaphragm moving means 55 are also positioned at above positions apart from the diaphragm member 30, as shown in FIG. 5(A).

And the suction passage opening and closing portion 33 is pressed by an elastic force of the diaphragm member 30 against the flat seal portion 20B finished by lapping of the diaphragm member 20 and closes the liquid suction passage 40. Thanks to this, a liquid 41 fed into the measuring space 42 is partitioned from the suction port 22 side by the suction passage opening and closing portion 33 and is measured.

Following this, when a voltage is applied to the piezoelectric device 62, since the piezoelectric device 62 changes in length, the connecting member 56 moves downward relative to the lid member 70. The quantity of movement is controlled by the value of a voltage applied to the piezoelectric device 62 and the like, and this value of a voltage is controlled by means of a timer (controller) in this embodiment.

That is to say, the quantity of displacement (change in length) of a piezoelectric device is controlled by the value of a voltage applied to the piezoelectric device. The adjustment of an applied voltage is performed ordinarily by means of a slide transformer and the like, but such a transformer is so large and heavy that it is difficult to realize a compact controller. And since a piezoelectric element is equivalent to a capacitor, it is provided with a charging characteristic similar to that of a capacitor. Due to this, since the stabilization of operation takes a long time, the adjustment of a stroke (displacement) by a power source voltage cannot smoothly change over one of the two piezoelectric devices 61 and 62 to the other in operation and may result in causing a so-called double-beat operation (double-step discharge).

Thereupon, this embodiment controls the adjustment of a voltage to a specified value by means of the time passing from the start of charging (charging time), namely, by means of a timer through confirming the charging characteristics of the piezoelectric devices 61 and 62 and obtaining a voltage value to the time from the start of charging in advance.

Figure 6:
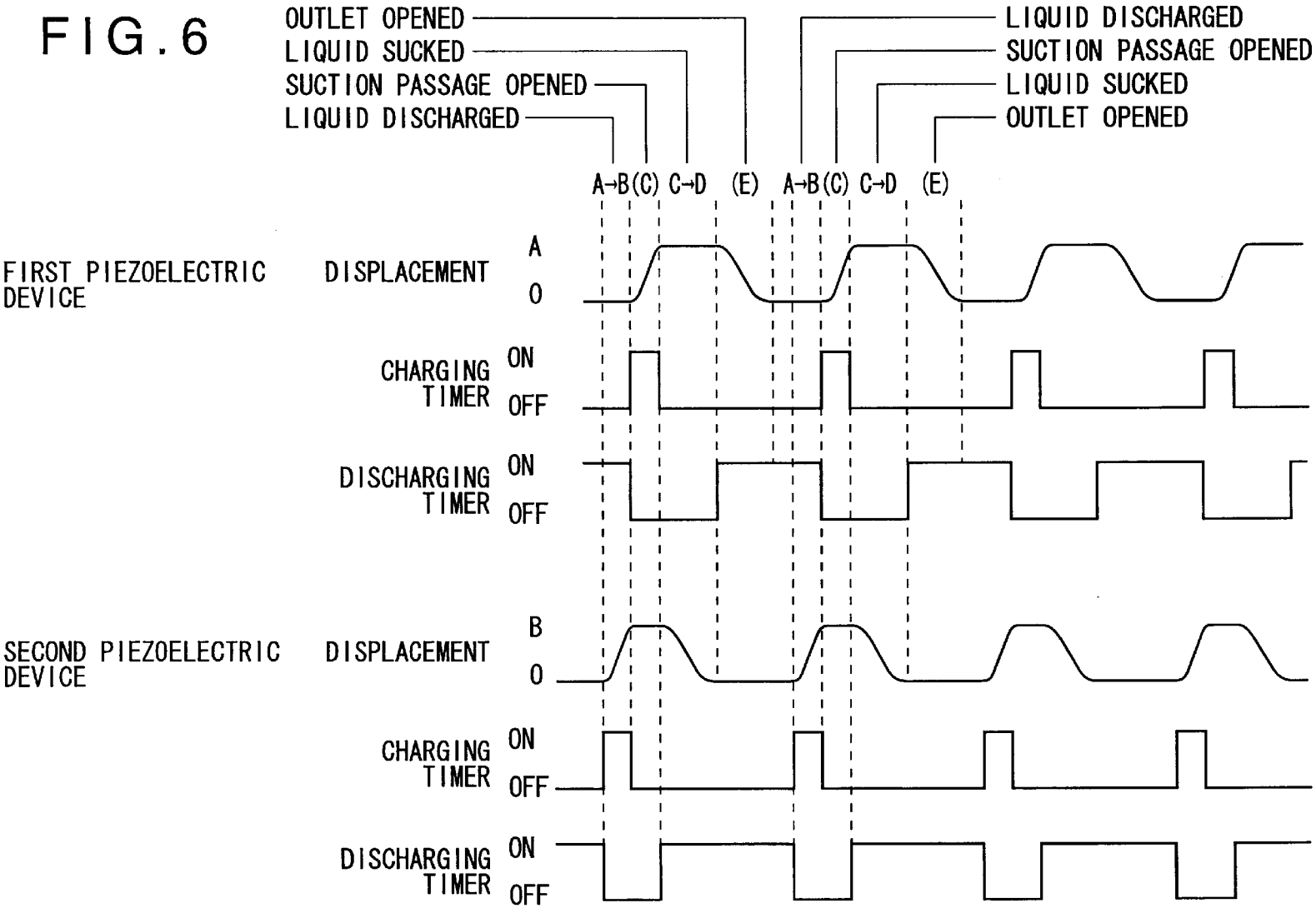
FIG. 6 is an explanatory diagram showing the operation of a timer in a controller of said first embodiment.

That is to say, as shown in FIG. 6, when a specified charging time set in advance by a charging timer has passed, the charging operation is stopped. If discharge is not performed when the charging operation is at a stop, the piezoelectric devices 61 and 62 keep a specified voltage value and therefore the quantity of displacement is also kept.

On the other hand, in order to restore the quantities of displacement (changed lengths) of the piezoelectric devices 61 and 62 to their original values, it is enough to start discharging them by means of a timer when a specified time has passed from the start of charging. This discharging is continued until the next charging is started.

Figure 5B:
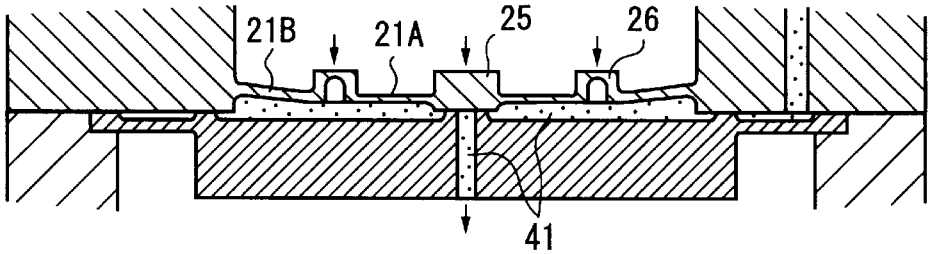

When the connecting member 56 is moved downward by a specified distance by applying a specified voltage to the second piezoelectric device 62, the outlet moving means 50 disposed under the connecting member 56 through the first piezoelectric device 61 and the diaphragm moving means 55 connected to the connecting member 56 are moved downward together with the connecting member 56. Due to this, as shown in FIG. 5(B), the outlet opening and closing portion 25 and the measuring portion 26 of the diaphragm member 20 are moved downward at the same time and the volume of the measuring space 42 partitioned by the suction passage opening and closing portion 33 is reduced.

Due to this, the liquid 41 of a quantity corresponding to the reduction in volume of the measuring space 42 is discharged through the outlet 35 of the diaphragm member 30 from the discharging needle 39 until the outlet 35 is closed by a fact that the outlet opening and closing portion 25 is pressed against the outlet 35.

Following this, a specified voltage is applied also to the first piezoelectric device 61 as keeping the second piezoelectric device 62 at a specified voltage. Thereupon, since the piezoelectric device 61 is moved, only the outlet opening and closing means 50 is moved downward relative to the diaphragm moving means 55.

Figure 5C:
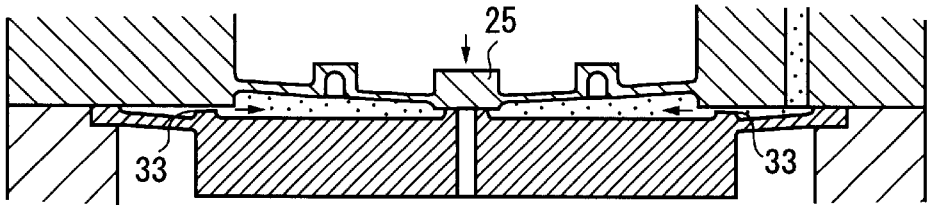
Figure 5D:
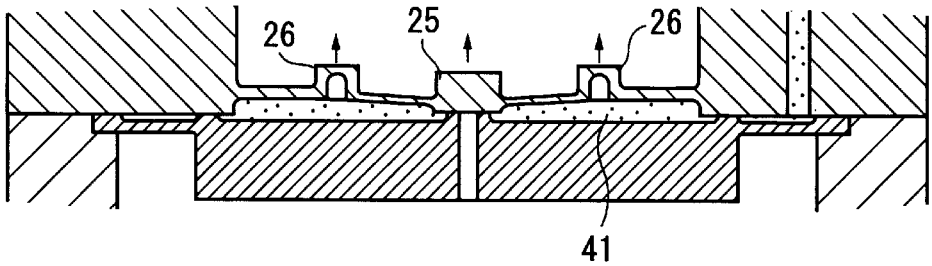

Due to this, as shown in FIG. 5(C), since the outlet opening and closing portion 25 is pressed against the outlet 35 of the diaphragm member 30 and is moved downward as it is kept in this state, the diaphragm portion 31 of the diaphragm member 30 is deformed and the suction passage opening and closing portion 33 is detached from the flat seal portion 20B. Accordingly, the suction passage opening and closing portion 33 is opened and the liquid 41 flows from the suction port 22 into the measuring space 42.

Next, when an applied voltage is lowered by discharging electricity from the second piezoelectric device 62, the piezoelectric device 62 restores its original length, and since a load applied by the piezoelectric device 62 to the diaphragm member 20 through the connecting member 56, the diaphragm moving means 55 and the outlet opening and closing means 50 is removed, the outlet opening and closing portion 25 and the measuring portion 26 of the diaphragm member 20 are moved upward by the elasticity (spring) of the diaphragm member 20.

However, since the piezoelectric device 61 is kept at a set voltage, the outlet opening and closing means 50 is kept at a position lower by the amount of displacement (amount of change in length) of the piezoelectric device 61 relative to the diaphragm moving means 55. In short, the outlet opening and closing means 50 and the diaphragm moving means 55 are moved upward together on the whole as keeping their positions relative to each other.

In response to this movement, the diaphragm member 30 is also moved upward by its own elasticity and the suction passage opening and closing portion 33 is pressed against the flat seal portion 20B. Thus the liquid suction passage 40 is closed, where a sucking operation is performed until the liquid suction passage 40 is closed.

Figure 5E:
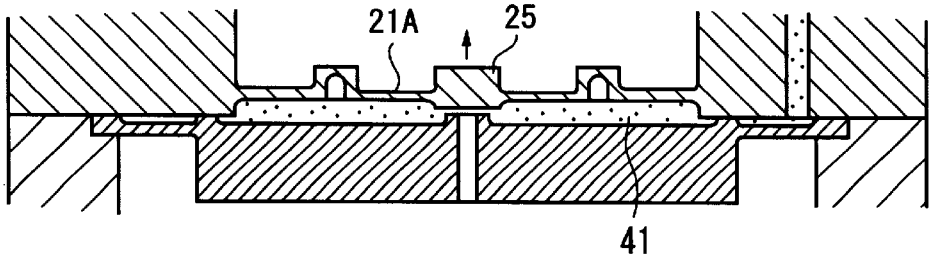

Next, when an applied voltage is lowered by discharging electricity from the piezoelectric device 61, the piezoelectric device 61 restores its original length, and as shown in FIG. 5(E) since a load applied by the piezoelectric device 61 to the outlet opening and closing portion 25 through the outlet opening and closing means 50 is removed, the outlet opening and closing portion 25 is moved back to its original position particularly by the elasticity of the diaphragm portion 21A and returns to the initial state shown in FIG. 5(A).

When the outlet opening and closing portion 25 is moved upward away from the outlet 35, the measuring space 42 is depressurized by this movement and the liquid 41 inside the outlet 35 is sucked into the measuring space 42. And since the suction passage opening and closing portion 33 is pressed against the flat seal portion 20B and is partitioned from the suction port 22, a new liquid 41 does not flow in from the suction port 22. Therefore, the discharge of liquid 41 from the discharging needle 39 is stopped even if a check valve and the like are not provided in particular.

And the amount of discharged fluid in this embodiment is determined by the quantity of change in volume of the measuring space 42, namely, the amount of movement of the measuring portion 26. Therefore, the amount of fluid to be discharged can be controlled by controlling the amount of displacement (change in length) of the second piezoelectric device 62 through controlling the voltage of it according to its charging time.

According to such an invention, the following effects can be obtained.

(1) Since a valve member composed of the diaphragm member 30 is made movable in the axial direction of the outlet 35 and the suction passage opening and closing portion 33 is opened and closed by this movement and this movement is performed by the elastic force of the diaphragm member 30 itself and the amount of displacement (change in length) of the outlet opening and closing means 50, namely, the amount of displacement (change in length) of the piezoelectric devices 61 and 62, it is not necessary to separately provide an independent driving mechanism for driving the suction passage opening and closing portion 33. Thanks to this, since the structure of a driving mechanism is simplified and the sealed faces of the diaphragm members 20 and 30 can be also made smaller in area due to a smaller number of driving mechanisms, the fluid discharging device 1 itself can be made small-sized.

(2) Since the sealed faces of the diaphragm members 20 and 30 can be made small in area, the amount of change in volume when the outlet opening and closing means 50 or the diaphragm moving means 55 is moved can be made small, and thereby it is possible to realize a dispenser for discharging a very small amount of fluid.

Moreover, since the suction passage opening and closing portion 33 is at a stop as being pressed against the flat seal portion 20B when a liquid 41 is discharged, the amount of liquid to be discharged can be made very small. For example, the amount of displacement (change in length) of each of the piezoelectric devices 61 and 62 is only about 10 to 20 $\mu$m maximum, the amount of liquid 41 to be discharged can be also controlled very finely to a degree of 1 microliter to 10 nanoliters.

(3) Since the piezoelectric devices 61 and 62 are used as driving sources of the diaphragm members 20 and 30, the amount of displacement of each of the diaphragm members 20 and 30 can be made as very small as about 10 to 20 $\mu$m. Therefore, the diaphragm members 20 and 30 can be made of a material being not capable of being much deformed such as stainless steel and the like.

And since the diaphragm members 20 and 30 made of metal can be used, it is possible to enhance the elasticity (spring) of the diaphragm itself, more simplify the structure without the need of providing another member such as a spring and the like as a means for energizing the diaphragm, make the fluid discharging device 1 small-sized, improve its assembling and working ability, and reduce its manufacturing cost.

(4) Since the diaphragm member 30 itself being a valve member having a discharging needle 39 attached to it is moved and the amount of movement of it is very small, this has no influence on the installation of the fluid discharging device 1. Particularly, in case of discharging a liquid 41 such as an adhesive agent or the like to such an object as IC or the like, since the tip of the discharging needle 39 is positioned at a specified distance from the object and the liquid 41 is flied and adhered to the object, a slight vertical movement of the diaphragm member 30, namely, of the discharging needle 39 has no influence on the discharge of liquid. Further, also in case of discharging such a liquid 41 as chemicals and the like, since in general the liquid is fed through a tube connected with the discharging needle 39, a slight movement of the discharging needle 39 is absorbed by deformation of the tube and has no influence on feeding of the liquid 41.

In case of discharging a very small amount of liquid 41 in a similar way to this embodiment, therefore, since the amount of movement of the discharging needle 39 or the diaphragm member 30 is very small, there is no hindrance in discharging a liquid 41 or in installing the fluid discharging device 1 and a liquid 41 can be surely discharged and the installation can be easily performed.

(5) Since the piezoelectric devices 61 and 62 are used as driving mechanisms, it is possible to make the action very fast and make the operation in a short cycle time. That is to say, since the piezoelectric devices 61 and 62 themselves can perform a high-speed operation of 1 kHz or more and the fluid discharging device 1 can perform a liquid discharging operation at one time per operation of the piezoelectric devices 61 and 62, although the speed of operation is limited by the follow-up ability of the displacement (change in length) of the diaphragm members 20 and 30, it is possible to perform a liquid discharging operation being extraordinarily higher in speed in comparison with the prior art.

(6) Since the amount of displacement (change in length) of the piezoelectric devices 61 and 62 can be controlled by the value of a voltage, it is possible to perform a high-accuracy and easy control.

Moreover, since said embodiment utilizes the charging characteristics of the piezoelectric devices 61 and 62 and controls them by the time measured by a charging or discharging timer and it is enough to only provide a small timer such as a digital IC, a microcomputer and the like, the fluid discharging device 1 can be made more small-sized, and since the outlet opening and closing means 50 and the diaphragm moving means 55 can be accurately controlled by the piezoelectric devices 61 and 62, a double-beat discharging operation and the like can be prevented.

(7) In the diaphragm members 20 and 30, since a method in which the outlet 35 is closed by bringing the respective flat portions of the outlet opening and closing portion 25 and the central part 32 into close contact with each other and the liquid suction passage 40 is closed by bringing the suction passage opening and closing portion 33 and the flat seal portion 20B into close contact with each other, namely, a so-called flat seal method is used, a dead space can be made very small and the stagnation of air and the like can be also prevented. Thanks to this, even an extremely small amount of liquid to be discharged can be measured and discharged with high accuracy.

Moreover, since the diaphragm members 20 and 30 made of stainless steel or the like can make said respective seal faces finished by lapping with high accuracy, they can be easily manufactured low in cost and can be formed with sufficient precision.

(8) Since each of the diaphragm members 20 and 30 is moved upward by its own elastic force and the driving operation by the piezoelectric devices 61 and 62, the outlet opening and closing means 50 and the diaphragm moving means 55 acts only downward, namely, in the pressing direction, no backlash appears between the driving members and the respective driving parts can be driven smoothly and accurately, and from this point also, a very small amount of liquid 41 can be discharged with high precision.

(9) In case of discharging a very small amount of liquid 41, even a slight error by thermal expansion or the like caused by variation in temperature of a spot using a fluid discharging device 1 results in influencing the accuracy of amount of liquid to be discharged, but since in said embodiment the body 2 is made of a material being very small in thermal expansion such as an Invar alloy and the like, it is possible to suppress the influence by thermal expansion in the body 2 having the largest dimension in length in the fluid discharging device 1 to the minimum.

Further, the piezoelectric devices 61 and 62 each have a negative thermal expansion coefficient and are made small in length with the rise of temperature, but since resin sheets 52 of a positive thermal expansion coefficient are arranged adjacently to the piezoelectric devices 61 and 62, it is possible to suppress the displacement caused by thermal expansion to the minimum as the whole piezoelectric devices 61 and 62, namely, relative to the outlet opening and closing means 50, the diaphragm moving means 55 and the connecting member 56.

(10) Since the piezoelectric devices 61 and 62 are connected with the outlet opening closing means 50, the diaphragm moving means 55 and the connecting member 56 which are made of metal or the like through the resin sheets 52 each having a cushion function, it is possible to prevent the piezoelectric devices 61 and 62 from being broken.

(11) In the diaphragm member 20, since the diaphragm portion 21A and the diaphragm portion 21B are made different in thickness from each other and the initial pressure of the diaphragm portion 21B at the peripheral side (a force pressing the diaphragm moving means 55) is made larger than a force applied when the diaphragm portion 21A at the central side is operated (deformed), the movement of only the outlet opening and closing means 50 makes it possible to move only the diaphragm portion 21A, and thereby it is possible to control the operations of the outlet opening and closing portion 25 and the measuring portion 26 surely separately from each other.

Since when the diaphragm moving means 55 is moved the outlet opening and closing means 50 also is moved in linkage with it, it is possible to move the outlet opening and closing portion 25 and the measuring portion 26 as surely securing their positions relative to each other.

(12) In the diaphragm member 20, since the measuring portion 26 is formed by bending the diaphragm portion 21 in the shape of a rib, it is possible to surely separate the displacement of the diaphragm portion 21A and the displacement of the diaphragm portion 21B from each other and distinguish between the operations of the outlet opening and closing portion 25 and the measuring portion 26.

(13) Since the diaphragm members 20 and 30 are used, the leakage of liquid 41 to a driving mechanism side can be prevented. Thanks to this, the number of sealed parts can be made smaller in comparison with a conventional plunger-type pump and the sealed structure can be simplified.

(14) Since the number of portions being in contact with liquid is so small that they are only the diaphragm members 20 and 30, even when the use of a material being excellent in chemical resistance and high in unit cost such as titanium, hastelloy or the like is required, it is possible to reduce the cost with a little usage of it and provide a fluid discharging device 1 with a low price.

(15) Moreover, since a liquid 41 to be discharged is measured being confined in the measuring space 42 partitioned by pressing the suction passage opening and closing portion 33 against the flat seal portion 20B, namely, is measured in volume using a forced valve, it is possible to measure even a very small amount of liquid to be discharged with high precision.

Moreover, since the outlet opening and closing portion 25, the measuring portion 26 and the suction passage opening and closing portion 33 of the diaphragm members 20 and 30 are arranged in the shape of concentric circles, the movements of the respective parts are made symmetric with regard to the central axis and thereby the respective parts can be stably operated, and since variation in volume to be caused by deformation of some parts does not occur, it is possible to discharge a liquid 41 with high accuracy and high reliability.

(16) Since when the diaphragm moving means 55 is moved the outlet opening and closing means 50 is also moved in one body with it, the outlet 35 can be closed by the outlet opening and closing portion 25 simultaneously with the completion of discharging a liquid 41, and therefore it is possible to prevent the double-step discharge of liquid 41 which may occur in case of closing the outlet 35 after the completion of discharge and to discharge the liquid 41 at one step.

Thanks to this, since the discharged liquid is not doubled by a double-step discharge of liquid 41 even in case of discharging a large amount of liquid or discharging a quick-dry liquid 41, a discharged liquid is not exfoliated and does not injure a beautiful appearance.

(17) Moreover, since it is not until the outlet opening and closing portion 25 of the diaphragm member 20 is pressed against the central part 32 in which the outlet 35 of the diaphragm member 30 is formed and then the outlet opening and closing portion 25 and the central part 32 are moved downward by the outlet opening and closing means 50 that the suction passage opening and closing portion 33 is opened, it is possible to surely keep the suction passage closed by the suction passage opening and closing portion 33 when the outlet 35 is open, and keep the outlet 35 closed when the suction passage is open. That is to say, since this embodiment discharges a liquid 41 by providing forced valves (the outlet opening and closing portion 25 and the suction passage opening and closing portion 33) to be driven from the outside, it is possible to make unnecessary a check valve which may cause the degradation in accuracy of discharging a very small amount of liquid and to discharge even a very small amount of liquid 41 with high precision.

(18) And since a liquid 41 to be confined inside the suction passage opening and closing portion 33 of the diaphragm member 30 is sucked through the liquid suction passage 40 surrounding the suction passage opening and closing portion 33 arranged in the shape of a concentric circle, it is possible to make the area of suction large. Thanks to this, even in case of feeding a liquid 41 under the atmospheric pressure from a container 8, it is possible to suck a sufficient amount of liquid 41 in a short time. Therefore, it is possible to shorten a suction time of liquid 41, namely, a working time, and since a constant amount of liquid 41 can be always sucked and measured accurately inside the suction passage opening and closing portion 33 and it is not necessary to use a pressure pump for feeding liquid 41, it is not necessary to use a material for pressurization in a flow passage and it is possible to provide a fluid discharging device being easy to use and low in price.

(19) Moreover, even in case of using a pressure pump in order to discharge a liquid of high viscosity, since the outlet opening and closing portion 25, the measuring portion 26 and the suction passage opening and closing portion 33 are arranged in the shape of concentric circles, the pressure tightness can be made high, and since a check valve can be made unnecessary, a liquid 41 can be also fed under a comparatively high pressure.

(20) And in a liquid 41 of high viscosity such as paste, the discharge of liquid is delayed when the pump and the outlet 35 are distant from each other, and according to this embodiment, since the diaphragm members 20 and 30 for performing a liquid 41 discharging operation and the outlet 35 are very close to each other, no delay occurs even in case of discharging a high-viscosity liquid.

(21) Furthermore, since parts to be in contact with liquid are only the diaphragm members 20 and 30, a washing operation is easy. Thanks to this, it is possible to cope with a case of changing the kind of liquid 41 to be discharged easily and in a short time.

And since the faces of the diaphragm members 20 and 30 to be pressed against each other are only the portions being thick in thickness and the measuring portion 26 and the like are not pressed against the diaphragm member 30, it is possible to make the diaphragm members 20 and 30 less in wear and longer in life.

Second Embodiment

Next, a second embodiment of the present invention is described with reference to FIGS. 7 to 9. In this embodiment, the same symbol is given to a similar component to or the same component as that of said first embodiment, and the description for it is omitted or simplified.

A fluid discharging device 100 of this embodiment replaces the piezoelectric devices 61 and 62 with an air drive as said driving mechanism.

Figure 7:
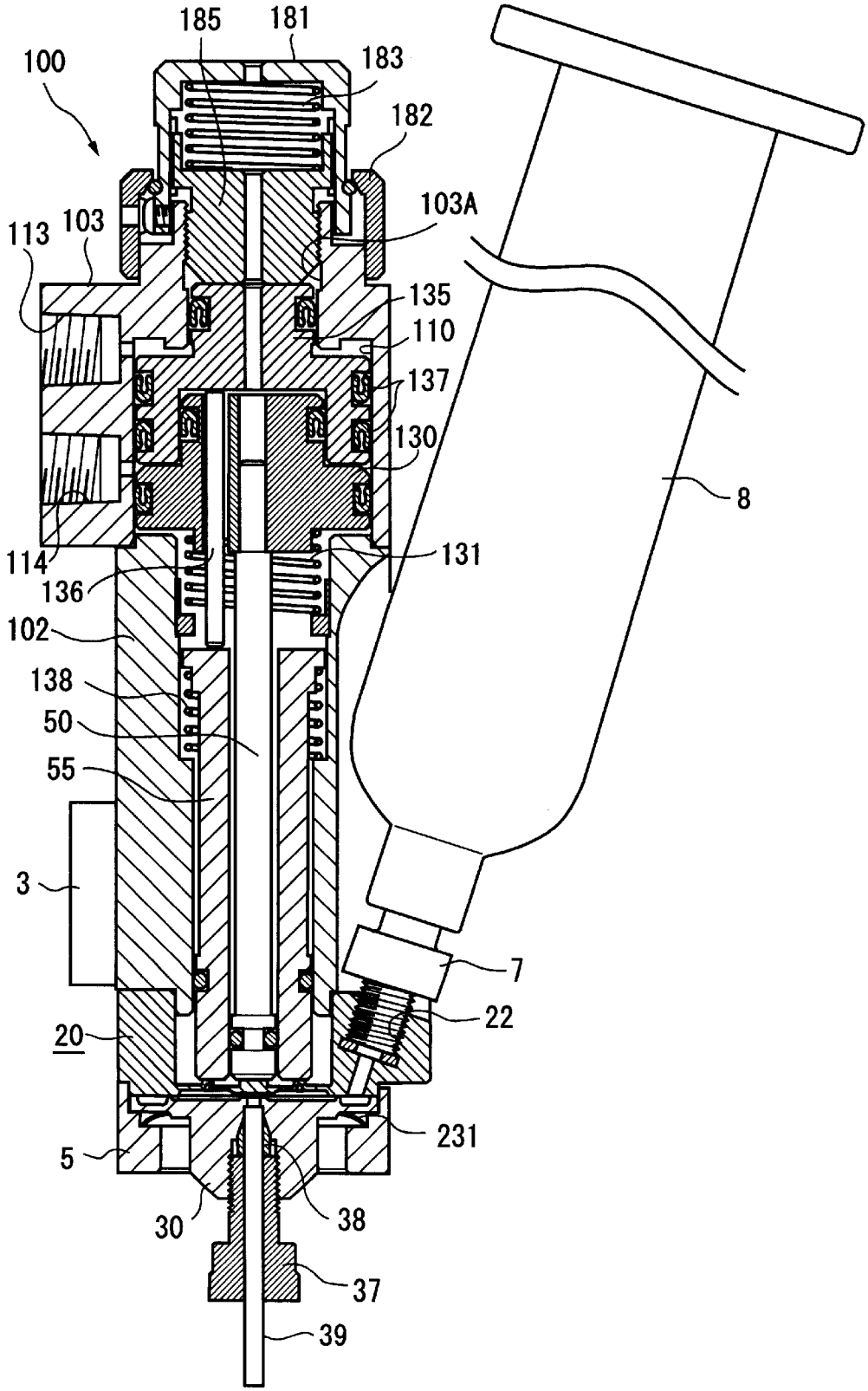
FIG. 7 is a vertical sectional view showing a second embodiment of the present invention.
Figure 8:
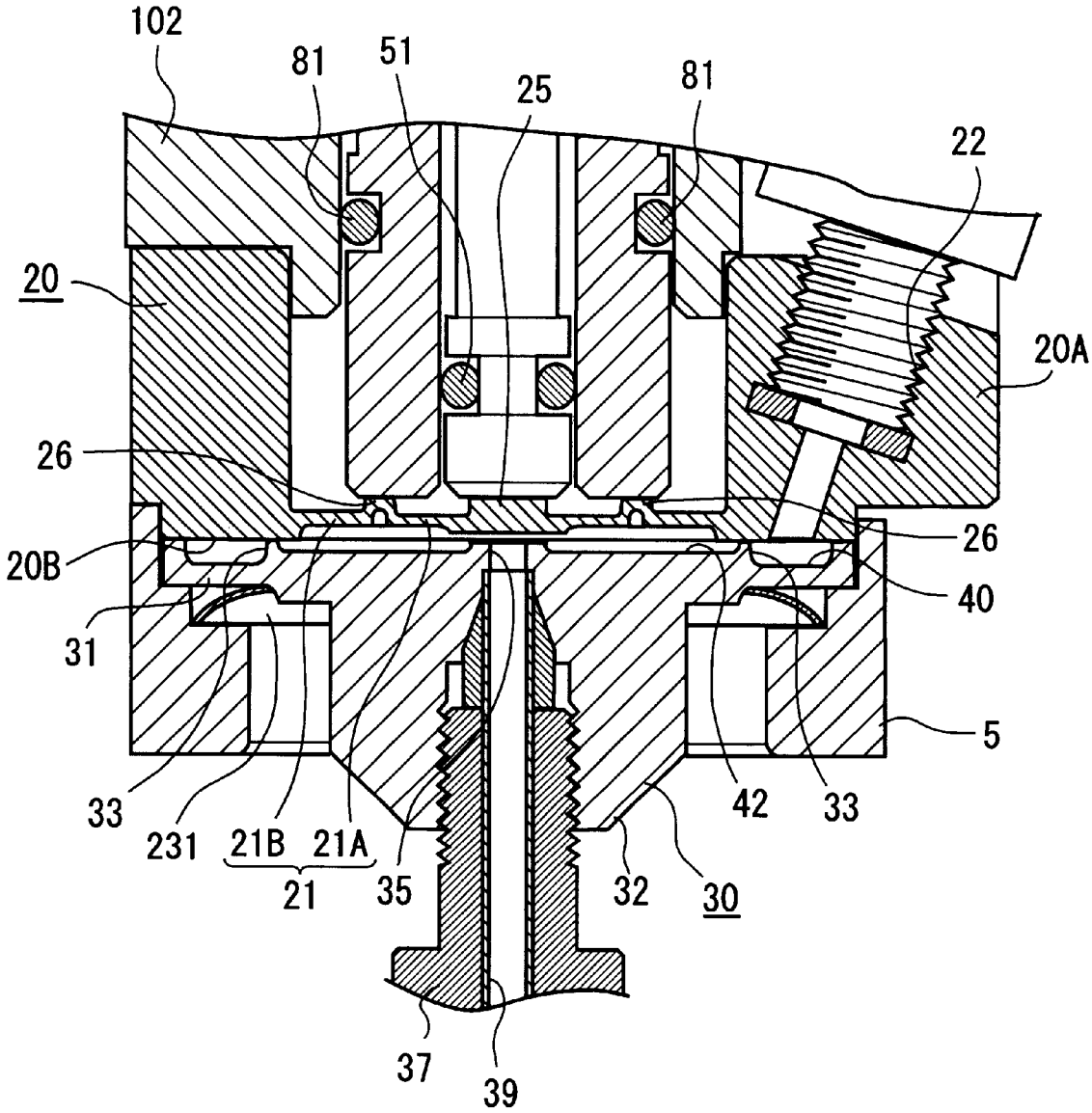
FIG. 8 is a sectional view showing a main part of said second embodiment.

As shown in FIG. 7, a fluid discharging device 100 comprises a body 102, a port block 103, diaphragm members 20 and 30, and a fixing plate 5, and these are coupled by four bolts.

The port block 103 has a cylinder 110 formed inside it. And in the port block 103, two cylinder ports 113 and 114 for feeding compressed air to the cylinder 110 are formed distantly from each other in the axial direction of the port block 103.

A first piston 130 and a second piston 135 are inserted into the cylinder 110 so as to be slidable in the axial direction. An outlet opening and closing means 50 being in the shape of a rod extended to an outlet opening and closing portion 25 of the diaphragm member 20 is projectively provided in the central shaft part of the first piston 130.

The upper shaft part of the second piston 135 is inserted into a through hole 103A being in communication with the cylinder 110 and passing through the upper end face of the port block 103, and the lower part of it is arranged so as to be capable of being pressed against the first piston 130. And the upper shaft part of the first piston 130 is inserted into a depressed part formed in the lower central part of the second piston 135.

Three through holes are formed in the first piston 130 around and along the axis of it, and an interlocking rod 136 is inserted into each of these through holes so as to be movable in the axial direction.

The top end of the interlocking rod 136 is made to be capable of being pressed against the bottom face of the second piston 135, and the bottom end of it is made to be capable of being pressed against the top face of a diaphragm moving means 55 being in the shape of a pipe.

U-seals are provided on outer peripheral faces of the pistons 130 and 135 to be in contact with the inner face of the cylinder 110, the inner face of the through hole 103A and the inner face of the depressed part of the piston 135, said U-shaped seals 137 sealing up these components so that compressed air fed into the cylinder 110 does not leak.

The first piston 130 is energized upward by a coil spring 131 and the second piston 135 is energized upward through the interlocking rod 136 and the diaphragm moving means 55 by a coil spring 138.

And by properly determining the positions of openings of the cylinder ports 113 and 114 and the position where the pistons 130 and 135 come into contact with each other, the piston 135 can be moved downward against the energizing force of the coil spring 131 when compressed air is fed into the cylinder port 113.

And when compressed air is fed into the cylinder port 114, the piston 130 can be moved downward against the energizing force of the coil spring 138.

As shown in FIG. 7, a discharge quantity adjusting member 185 is screwed into an internal thread of the through hole 103A in the upper part of the port block 103.

A cap nut 181 is spline-fitted onto this discharge quantity adjusting member 185. This cap nut 181 is detachably engaged with the port block 103 by an engaging ring 182 regulating the movement in the axial direction.

And a coil spring 183 is interposed between the discharge quantity adjusting member 185 and the cap nut 181. And when the cap nut 181 is turned, the discharge quantity adjusting member 185 spline-fitted into this is also turned relative to the port block 103 and thereby the axial position of the discharge quantity adjusting member 185 can be adjusted relative to the port block 103.

The diaphragm member 20 is formed out of resin or the like being excellent in chemical resistance such as fluororesin or the like, and an outlet opening and closing portion 25 and a measuring portion 26 are formed in the diaphragm portion 21 in the same way as the first embodiment.

And the diaphragm member 30 is formed also out of resin or the like being excellent in chemical resistance such as fluororesin or the like, and a diaphragm portion 31, a suction passage opening and closing portion 33 and the like are formed in it in the same way as the first embodiment.

Since these resins each have an elastic force (spring force) by themselves, the outlet opening and closing portion 25 and the measuring portion 26 are moved upward by their own elastic forces when the energizing forces by the outlet opening and closing means 50 and the diaphragm moving means 55 are removed.

The suction passage opening and closing portion 33 is also moved upward by an elastic force of the diaphragm portion 31, but since a diaphragm made of resin itself has a smaller elastic force in comparison with a diaphragm made of metal and a load of the central part 32 is also applied to the diaphragm portion 31, the suction passage opening and closing portion 33 is more difficult to be moved in comparison with the outlet opening and closing portion 25 or the measuring portion 26. Therefore, this embodiment interposes a disc spring 231 between the diaphragm portion 31 and the fixing plate 5, and energizes the diaphragm portion 31 upward utilizing the force of the disc spring 231 also.

Each of the cylinder ports 113 and 114 is connected to a selector valve of a solenoid type through an unshown piping, and the selector valves each are connected to a pressure source such as a compressor and the like. These selector valves are controlled independently of each other by a controller.

Accordingly, a driving mechanism of the outlet opening and closing means 150 and the diaphragm moving means 155 is composed of said cylinder 110, cylinder ports 113 and 114, first and second pistons 130 and 135, coil springs 131 and 138, piping, selector valves, pressure source, and controller. Particularly, the diaphragm moving means 155 is moved by the actions of the cylinder port 113, the second piston 135 and the coil spring 138. And the outlet opening and closing means 150 is moved basically by the actions of the cylinder port 114, the first piston 130 and the coil spring 131 but is moved also by interlocking with the movement of the second piston 135, and therefore the driving mechanism of the outlet opening and closing means 150 comprises also these components.

And in this embodiment, since the suction passage opening and closing portion 33 is pressed against the flat seal portion 20B by the spring force of the diaphragm member 30 itself and the disc spring 231, an energizing means for closing the liquid suction passage 40 by energizing the suction passage opening and closing portion 33 is composed of the diaphragm member 30 and the disc spring 231.

Next, the operation of the second embodiment is described with reference to an operation explaining diagram of FIG. 9 also.

Before the start of operation, namely, in a state where the fluid discharging device 1 is at a stop, air is not fed into each of the cylinder ports 113 and 114. Due to this, the outlet opening and closing means 50 and the diaphragm moving means 55 are energized upward by the coil springs 131 and 138, and as shown in FIG. 9(A), the outlet opening and closing portion 25 and the measuring portion 26 are also at the upper stroke end position.

The upper stroke end position of the diaphragm moving portion 55 is made to be a position where the second piston 135 is pressed against the bottom face of the discharge quantity adjusting member 185. That is to say, when the discharge quantity adjusting member 185 is changed in level by turning the cap nut 181, the upper stroke end position of the diaphragm moving means 55 is also adjusted. And the upper stroke end position of the outlet opening and closing means 50 is made to be a position where the first piston 130 is pressed against the second piston 135. Due to this, when the upper stroke end position is adjusted by the cap nut 181 and the discharge quantity adjusting member 185, not only the upper stroke end position of the second piston 135 but also that of the first piston 130 are adjusted.

Figure 9A:
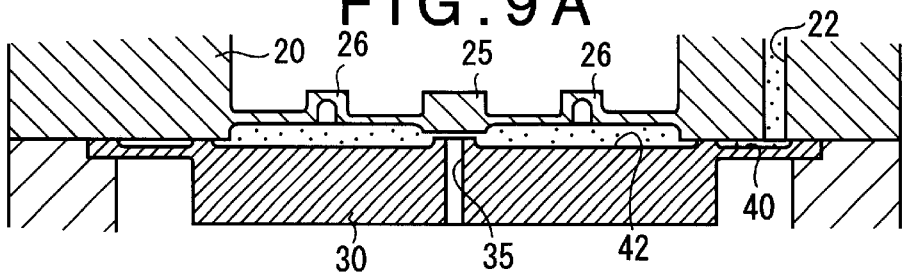
FIGS. 9A to 9F are diagrams for explaining the fluid discharging operation of said second embodiment.

And due to a fact that the outlet opening and closing means 50 and the diaphragm moving means 55 are at the upper stroke end position, the outlet opening and closing portion 25 and the measuring portion 26 of the diaphragm member 20 to be pressed against the diaphragm moving means 55 are also positioned at an above position distant from the diaphragm member 30, as shown in FIG. 9(A).

And the suction passage opening and closing portion 33 is pressed against the flat seal portion 20B finished by lapping of the diaphragm member 20 by the elastic forces of the diaphragm member 30 and the disc spring 231 and thereby closes up the liquid suction passage 40. Due to this, a liquid 41 fed through the liquid suction passage 40 is confined and measured in the measuring space 42 partitioned from the suction port 22 side by the suction passage opening and closing portion 33.

Following this, when compressed air is fed into the cylinder port 113, the second piston 135 is moved downward against the energizing force of the coil spring 138. At this time, since the second piston 135 is pressed also against the first piston 130, it is moved downward together with the first piston 130 against the energizing force of the coil spring 131 also.

That is to say, when compressed air is fed into the cylinder port 113, the respective pistons 130 and 135 are moved downward together, overcoming the energizing forces of the coil springs 131 and 138.

Figure 9B:
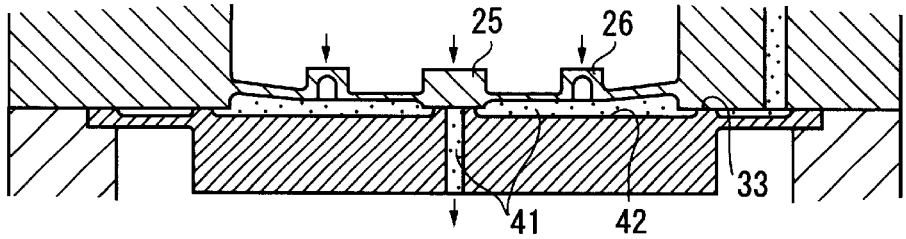

When the pistons 130 and 135 are moved downward, the outlet opening and closing means 50 and the diaphragm moving means 55 also are moved downward interlocking with them. Due to this, as shown in FIG. 9(B), the outlet opening and closing portion 25 and the measuring portion 26 of the diaphragm member 20 are moved downward at the same time, and the volume of the measuring space 42 partitioned by the suction passage opening and closing portion 33 is reduced.

Due to this, a corresponding amount of liquid 41 to the reduction in volume of the measuring space 42 is discharged from the discharging needle 39 through the outlet 35 of the diaphragm member 30 until the outlet opening and closing portion 25 closes the outlet 35 by being pressed against it.

And the pistons 130 and 135 are moved to a position where the piston 130 is pressed against the top end face of the body 102, namely, to the lower stroke end. This lower stroke end position is made to be a position where the bottom face of the outlet opening and closing portion 25 projects lowers toward the diaphragm member 30 side than the flat seal portion 20B. Therefore, due to a fact that a downward force is applied to the diaphragm member 30 from the outlet opening and closing means 50 through the outlet opening and closing portion 25, the diaphragm member 30 is moved downward against the energizing force of the disc spring 231. Following this, the diaphragm portion 31 of the diaphragm member 30 is deformed and the suction passage opening and closing portion 33 is detached from the flat seal portion 20B. Accordingly, the suction passage opening and closing portion 33 is opened and the measuring space 42 communicates with the suction port 22 through the liquid suction passage 40.

Subsequently, compressed air is fed into the cylinder port 114. At this time, since the piston 130 is at the lower stroke end position, the air fed into the cylinder port 114 attempts to move the second piston 135 upward.

Figure 9C:
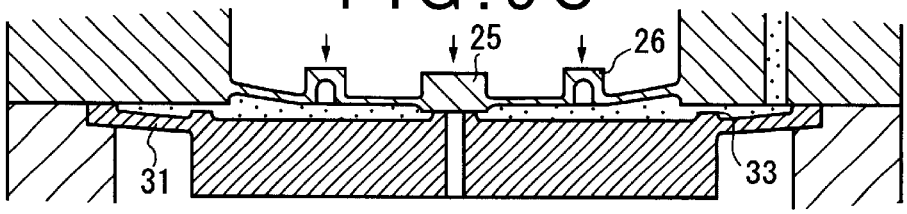

However, since compressed air is fed also into the cylinder port 113 and the second piston 135 is in contact with the compressed air in a larger area and receives a larger force, even if compressed air is fed into the cylinder port 113, the pistons 130 and 135 are kept respectively at their current positions without moving (in the state of FIG. 9(C)).

Next, when feeding air into the cylinder port 113 is stopped, the second piston 135 is moved to the upper stroke end position by the air fed into the cylinder port 114.

Figure 9D:
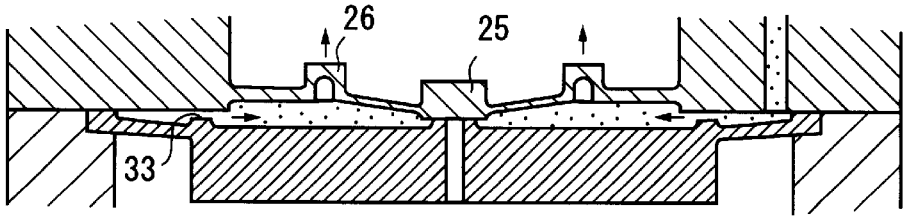

On the other hand, the first piston 130 is kept as it is energized downward by the air fed into the cylinder port 114. Due to this, as shown in FIG. 9(D), since the measuring portion 26 is moved upward in a state where the suction passage opening and closing portion 33 is open, a liquid 41 flows into the measuring space 42 through the liquid suction passage 40 from the suction port 22.

Figure 9E:
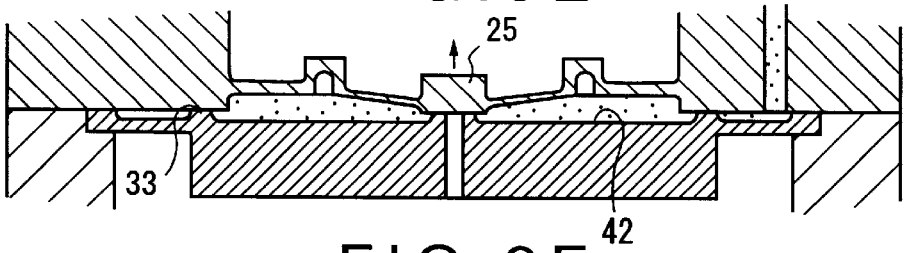

Next, feeding air into the cylinder port 114 is stopped, the first piston 130 is moved upward by the energizing force of the coil spring 131. With the movement of it, the outlet opening and closing means 50 and the outlet opening and closing portion 25 are also moved upward, and when the bottom face of the outlet opening and closing portion 25 comes to the same level as the flat seal portion 20B as shown in FIG. 9(E) in the middle course of movement, the suction passage opening and closing portion 33 is pressed against the flat seal portion 20B and the liquid suction passage 40 (suction passage opening and closing portion 33) is closed.

Figure 9F:
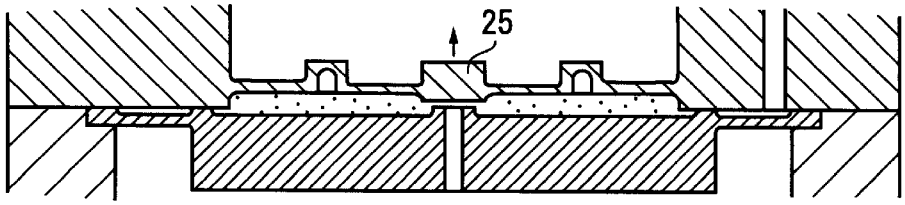

Further, the first piston 130 is moved to the upper stroke end where it is pressed against the second piston 135, and the outlet opening and closing means 50 also rises and the outlet opening and closing portion 25 is detached from the outlet 35 and returns to the initial state, as shown in FIG. 9(F).

When the outlet opening and closing portion 25 is detached from the outlet 35 and is moved upward, the liquid 41 inside the outlet 35 is sucked into the suction passage due to the depressurization caused by the movement of it. And since the suction passage opening and closing portion 33 is pressed against the flat seal portion 20B and is partitioned from the suction port 22, a new liquid 41 is not sucked from the suction port 22. Therefore, even if a check valve or the like is not provided in particular, the discharge of liquid 41 from the discharging needle 39 is stopped.

And a discharge quantity in this embodiment is also determined by the change in volume of the measuring space 42, namely, the amount of movement of the measuring portion 26. Therefore, the discharge quantity is controlled by controlling the amount of movement of the measuring portion 26 through adjusting the position of the discharge quantity adjusting member 185 and changing the upper stroke end position of the second piston 135.

This embodiment as described above can also bring the same effects as the effects except the effects obtained by using a piezoelectric device as a driving source in said first embodiment, namely, the same effects as items (1), (2), (4), (7) to (9), and (11) to (21).

(22) Moreover, since the diaphragm members 20 and 30, namely, portions to be in contact with liquid are formed out of resin, it is possible also to discharge a liquid 41 reacting to metal and the like such as ultraviolet-setting resin or the like. And in case of discharging a liquid 41 containing hard fillers such as an abrasive, silica and the like, a diaphragm of metal is difficult to use since it is liable to wear off, but a diaphragm made of resin such as the diaphragm members 20 and 30 is also suitable for discharging a liquid 41 containing hard fillers since it is only deformed and is hard to wear off even when it receives hitting of fillers.

(23) And since the diaphragms 20 and 30 of resin can be made larger in amount of deformation than a diaphragm of metal, they can provide a larger amount of liquid to be discharged in comparison with a diaphragm of metal. For example, they can cope with the amount of discharge set to a degree of 5 microliters to 50 nanoliters. Therefore, in case of using a comparatively large amount of liquid to be discharged among cases of extremely small amount of liquid to be discharged, it is possible to sufficiently cope with such cases by using the diaphragms 20 and 30 made of resin.

(24) Furthermore, since this embodiment uses an air drive, it can be easily utilized for explosion-preventing specifications in which electricity and the like cannot be used.

Third Embodiment

Figure 10:
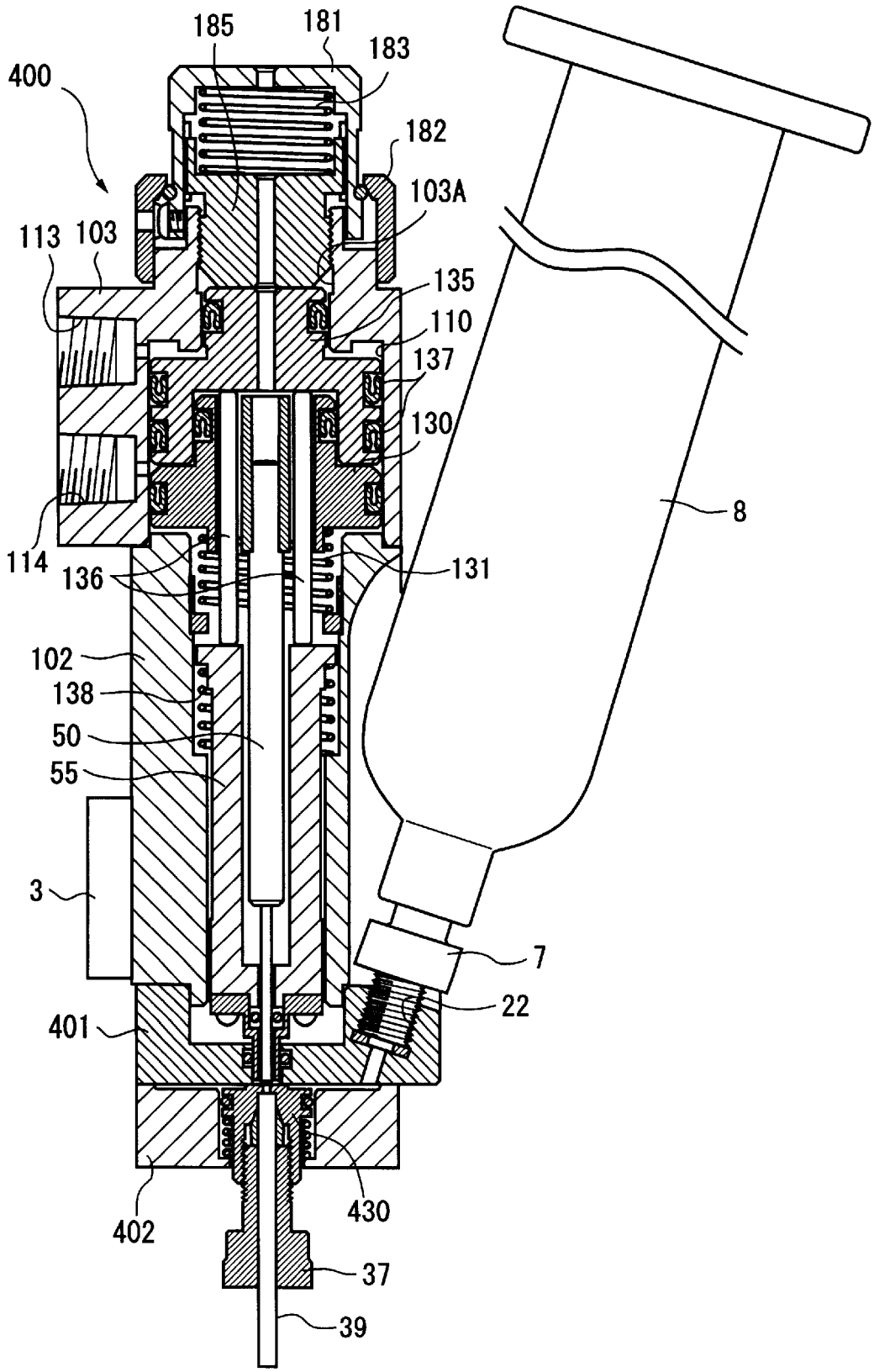
FIG. 10 is a vertical sectional view showing a third embodiment of the present invention.
Figure 11:
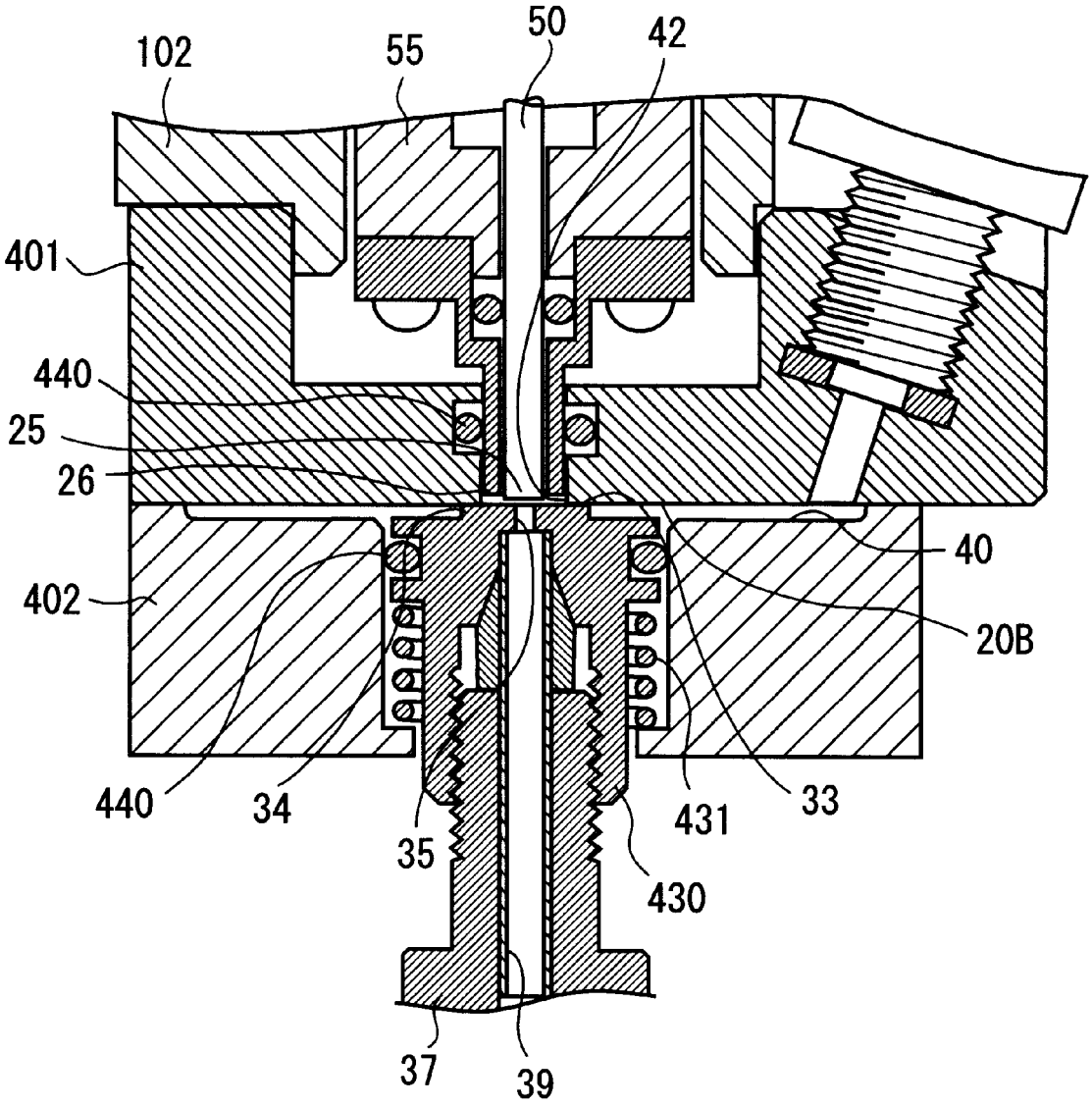
FIG. 11 is a sectional view showing a main part of said third embodiment.

Next, a third embodiment of the present invention is described with reference to FIGS. 10 and 11. While the fluid discharging devices 1 and 100 of the embodiments described above form the pump member and the valve member out of the diaphragm members 20 and 30, a fluid discharging device 400 of this embodiment forms them using a plunger and the like without using diaphragms.

That is to say, the fluid discharging device 400 is of an air drive type in the same way as the second embodiment, arranges an outlet opening and closing means 50 in the shape of a rod and a diaphragm moving means 55 in the shape of a pipe so as to be movable up and down relative to a pump block 401, and utilizes the lower end faces of them as an outlet opening and closing portion 25 and a measuring portion 26 instead of using diaphragms.

On the other hand, it arranges a valve member 430 having an outlet 35 formed in it so as to be movable in its axial direction relative to a valve block 402. This valve member 430 is energized upward by a coil spring 431, functions as a suction passage opening and closing portion 33 by pressing or detaching a projecting portion 34 around the outlet 35 against or from a flat seal portion 20B of the pump block 401, and makes it possible to open and close a liquid suction passage 40.

And the outlet opening and closing portion 25 being the lower end portion of said outlet opening and closing means 50 is made to make it possible to close the outlet 35 by being pressed against the projecting portion 34 of the valve member 430 and further press the valve member 430 downward against the energizing force of the coil spring 431, and detach the suction passage opening and closing portion 33 from the flat seal portion 20B to open the liquid suction passage 40. And the measuring portion 26 of the diaphragm moving means 55 is made to make it possible to change the volume of a space where the measuring portion 26 is inserted, namely, the volume of a measuring space 42 by moving upward and downward.

Seal members 440 each being composed of an O-ring or the like are respectively interposed between the diaphragm moving means 55 and the pump block 401 and between the valve member 430 and the valve block 402 to seal them.

Therefore, the pump member is composed of the pump block 401, the outlet opening and closing portion 25 of the outlet opening and closing means 50 and the measuring portion 26 of the diaphragm moving means 55, and the valve member is composed of the valve block 402 and the valve member 430. And the liquid suction passage 40 is defined and formed by the pump member and the valve member, and a space defined by the valve member 430, the pump block 401, the outlet opening and closing portion 25 and the measuring portion 26 when the suction passage opening and closing portion 33 of the valve member 430 is pressed against the flat seal portion 20B is defined as the measuring space 42.

In such a fluid discharging device 400, since its driving mechanism is the same as that of said second embodiment, the suction, measurement and discharge of a liquid 41 are performed by moving the outlet opening and closing portion 25, the measuring portion 26 and the suction passage opening and closing portion 33 in the same way as the second embodiment. And the quantity of liquid 41 to be discharged is also adjusted by the amount of movement of the measuring portion 26 in the same way as the second embodiment.

This embodiment described above can also bring the same effects as said respective embodiments.

(25) Moreover, since this embodiment adopts a plunger system, it can make smaller the area to be in contact with liquid (the area projected in the direction of movement) in comparison with a system using diaphragms. That is to say, the diaphragm members 20 and 30 need to provide the diaphragm portions 21A, 21B and 31 in order to move the outlet opening and closing portion 25, the measuring portion 26 and the suction passage opening and closing portion 33, and thereby makes larger the area to be in contact with liquid, but since a plunger system provides only the outlet opening and closing portion 25, the measuring portion 26 and the suction passage opening and closing portion 33, it can make smaller the area to be in contact with liquid. Thanks to this, since even an air drive mechanism having a larger stroke to some degree in comparison with the piezoelectric devices 61 and 62 can make the measuring space 42 smaller in area, it can discharge an extremely small amount of fluid.

VARIATION EXAMPLE

The present invention is not limited to the above-mentioned embodiments, but it includes variations, improvements and the like within the scope where the objects of the present invention are achieved.

Figure 12:
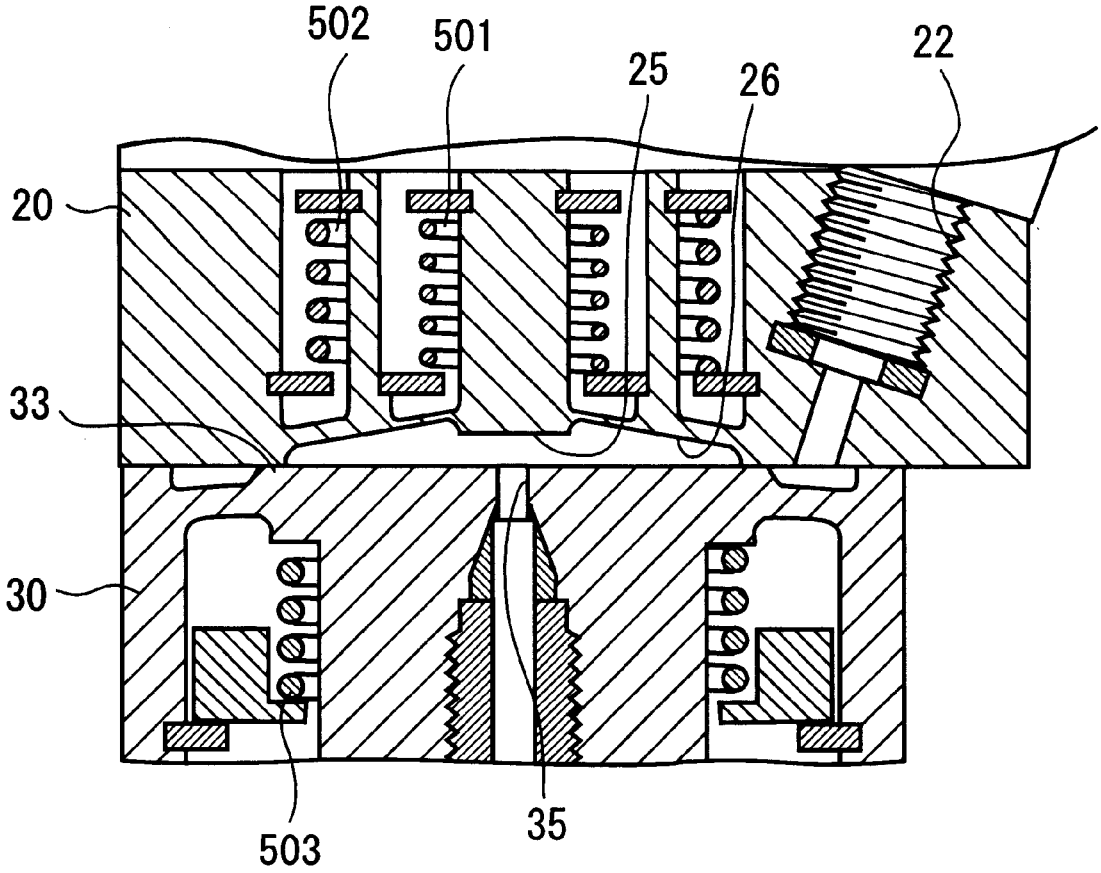
FIG. 12 is a sectional view showing a variation example of the present invention.

For example, said first and second embodiments move the outlet opening and closing portion 25, the measuring portion 26 and the suction passage opening and closing portion 33 by utilizing also the elastic forces of the diaphragm members 20 and 30 themselves, but as shown in FIG. 12, the outlet opening and closing portion 25, the measuring portion 26 and the suction passage opening and closing portion 33 of the diaphragm members 20 and 30 may be energized by coil springs 501 to 503. However, said first and second embodiments has an advantage that the diaphragm members 20 and 30 can be made more small-sized by making the coil springs 501 to 503 unnecessary.

In case of using such a coil spring as described above, it is desirable to provide a stopper structure for stopping the movement by the coil spring at a specified limit position.

Figure 13:
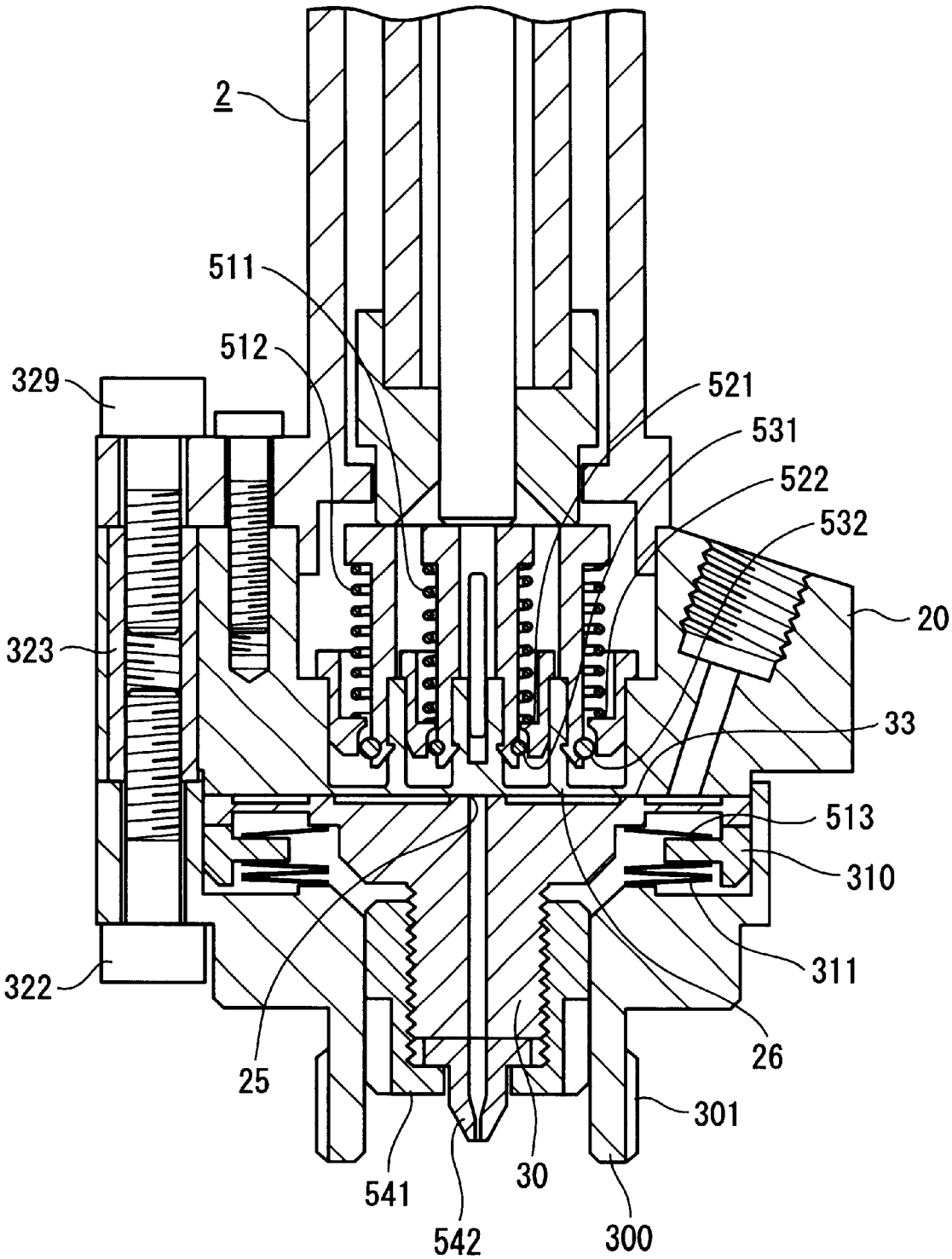
FIG. 13 is a sectional view showing a variation example of the present invention.

As shown in FIG. 13, coil springs 511 and 512 may be used in order to energize the outlet opening and closing portion 25 and the measuring portion 26 of the diaphragm members 20 and 30. At this time, it is possible to make a stopper structure by forming projecting portions 521 and 522 on one side members to engage with the lower ends of the coil springs 511 and 512, fitting engaging members 531 and 532 each being in the shape of a ring onto the other side members and thereby engaging the engaging members 531 and 532 with the projecting portions 521 and 522.

By this, it is possible to avoid a troublesome work such as operations performed as pressing down the springs at the time of assembling.

In a structure of FIG. 13, a disc spring 513 is provided as a means for energizing the suction passage opening and closing portion 33. This disc spring 513 is held by a pressing member 310, which is fixed by a cover member 300 together with a diaphragm member 30 through plural disc springs 311.

That is to say, four bolt structures (only one bolt structure is shown in FIG. 13) are arranged at uniform intervals in the lower peripheral part of a body 2. Each bolt structure is composed of upper and lower bolts 321 and 322 and a joint member 323, and penetrates the diaphragm member 20 and joins the body 2 with the cover member 300. The peripheral part of the diaphragm member 30, the peripheral part of the pressing member 310 and a plurality of disc springs 311 are held between the cover member 300 and the bottom face of the diaphragm member 20. Due to this, the diaphragm member 30 is held at a constant pressure exclusively by the energizing force of the disc springs 311, and this can further reduce the influence of a clamping force and the like at the time of assembling.

A cylinder-shaped collar 301 having a thread formed on its outer circumferential face is formed at the lower end part of the cover member 300, which can be screwed and fixed to an optional part by means of this collar 301.

Further, a nozzle 542 is attached by a pressing member 541 to the discharging side of the diaphragm member 30 and a liquid is discharged from this nozzle 542. The nozzle 542 and the pressing member 541 are exposed to the outside through the collar 301 of the cover member 300. The pressing member 541 is held with a slight clearance between it and the inner face of the collar 301 so as not to interfere with the cover member 300 when the diaphragm member 30 operates.

The first embodiment described above (see FIG. 1 and the like) uses the two piezoelectric devices 61 and 62, moves the connecting member 56 and the diaphragm moving means 55 forward and backward relative to the lid member 70 and the body 2 by means of the two piezoelectric devices 61 and 62, and moves the outlet opening and closing means 50 forward and backward relative to the connecting member 56 and the diaphragm moving means 55 by means of the piezoelectric device 61. That is to say, it is necessary to assemble the piezoelectric devices 61 and 62, the connecting member 56, the diaphragm moving means 55 and the outlet opening and closing means 50 inside the body 2. For this, the following structure can be adopted.

Figure 14:
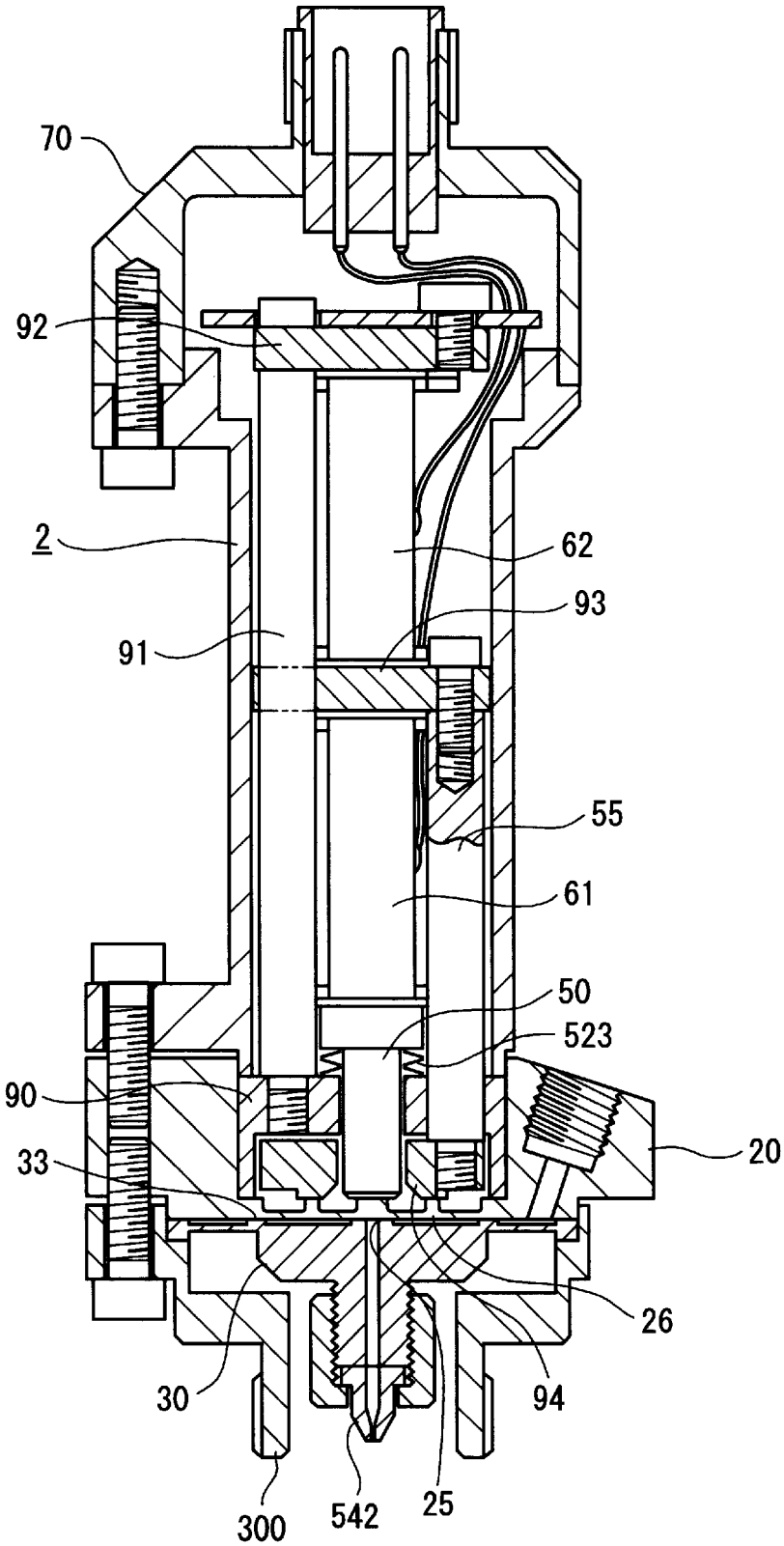
FIG. 14 is a sectional view showing a variation example of the present invention.

As shown in FIG. 14, a fixing member 90 is fixed to a diaphragm member 20, and one end of a tie rod 91 is fixed to the fixing member 90. An end member 92 is fixed to the other end of the tie rod 91, and a connecting member 93 is positioned in the middle part of the tie rod 91. The connecting member 93 is penetrated by the rod 91 and can move along the tie rod 91. One end of a diaphragm moving means 55 is fixed to the connecting member 93 and the other end of the diaphragm moving means 55 is fixed to an end member 94 disposed inside the fixing member 90. The end member 94 is connected to a measuring portion 26 of the diaphragm member 20.

The tie rod 91 and the diaphragm moving means 55 each are in the shape of a round pole and are made of Invar or the like having a small thermal expansion coefficient in order to improve the accuracy of operation.

The piezoelectric device 62 is disposed between the end member 92 and the connecting member 93, and can move the measuring portion 26 through the diaphragm moving means 55 with the expansion and contraction of it.

The piezoelectric device 61 is disposed between the connecting member 93 and the outlet opening and closing means 50. The end of the outlet opening and closing means 50 is connected to the outlet opening and closing portion 25. A disc spring 523 is interposed between the outlet opening and closing means 50 and the fixing member 90, and energizes the outlet opening and closing portion 25 in the direction of moving away from the diaphragm member 30. Accordingly, the outlet opening and closing portion 25 is closed and opened by the expansion and contraction of the piezoelectric device 61, and the suction passage opening and closing portion 33 is opened by further pressing the outlet opening and closing portion 25 in a closed state.

Such a structure of FIG. 14 can perform a similar operation to the first embodiment described above and can perform easily and efficiently an assembling operation by assembling the fixing member 90 or the end member 94, the piezoelectric devices 61 and 62 and the like in advance at the diaphragm member 20 side, and then assembling the body 2 in the shape of a tube and the lid member 70.

In the third embodiment described above, the valve member 430 and the valve block 402 may be formed out of the diaphragm member 30 in the first and second embodiments. That is to say, a plunger-typed pump member and a diaphragm-typed valve member may be combined with each other. In this case also, a discharge quantity can be made small thanks to a fact that the valve member is of a plunger type, and the coil spring 431 and the seal member 440 can be made unnecessary thanks to a fact that the valve member is of a diaphragm type and as a result an advantage that the structure can be made simple is obtained.

Further, fluid to be discharged by a fluid discharging device of the present invention may be not only liquid 41 but also gas and the like. Particularly, since the present invention measures in volume the fluid to be discharged by means of a forced valve, it can discharge even an extremely small amount of gas with high precision.

Furthermore, a material for the diaphragm members 20 and 30 may be a metal material with elasticity such as stainless steel, titanium, hastelloy and the like, and may be resin with elasticity such as polyethylene chloride trifluoride (CTFE) and the like. Further, in case of using the coil springs 501 to 503 as shown in FIG. 12, resin, metal or the like having no elasticity can be utilized. It is enough to select some of these materials properly in consideration of the kind, characteristic and the like of a liquid to be used.

Moreover, not only a driving mechanism using piezoelectric devices 61 and 62 or a driving mechanism of an air cylinder type like those of said embodiments, but also a driving mechanism using a cam and cam follower, a solenoid, a servomotor, a motor and a rack and pinion, and the like may be used as a driving mechanism.

And said embodiments assume that a state where the outlet 35 is opened and the suction passage opening and closing portion 33 is closed is a stop state of the fluid discharging device 1, 100 or 400, but depending upon the kind and the like of fluid to be discharged, a state where the outlet 35 is closed may be a stop state. When a controller can properly control the selection of such a reference state, it is possible to easily cope with various kinds of fluid.

Further, fluid may be made to flow backward by reversing the order of operations of said embodiments, for example, operating the first embodiment in the order of FIGS. 5(E) to 5(A) and operating the second embodiment in the order of FIGS. 9(F) to 9(A), and utilizing the outlet 35 as a fluid feeding side (inlet) and the liquid suction passage 40 side as an outlet in said embodiments. Such reversion of a discharging direction can be easily made only by reversing the operation of such a driving mechanism as the piezoelectric devices 61 and 62, the air cylinder and the like.

And the shape and the like of the outlet opening and closing means 50 and the diaphragm moving means 55 are not limited to said embodiments but may be other shapes and the like. In short, it is enough that they are arranged from the inner side to the outer side in the shape of concentric circles in the order of the outlet opening and closing means 50 and the diaphragm moving means 55.

Still further, in said first and second embodiments, the measuring portion 26 is formed by bending the diaphragm portion 21 in the shape of a rib, but it may be formed out of a thick portion in thickness in the same way as the outlet opening and closing portion 25. And the outlet opening and closing portion 25 and the measuring portion 26 may be made similar in thickness to other diaphragm portions 21A and 21B. However, making the outlet opening and closing portion 25 and the measuring portion 26 thicker in thickness than the diaphragm portions 21A and 21B, or forming the measuring portion 26 by bending it in the shape of a rib as in said embodiments is more preferable in that the diaphragm portion 21A and the diaphragm portion 21B can be surely separated in displacement from each other.

And a pump member and a valve member also are not limited in shape and material to said embodiments. Particularly, materials may be selected properly according to the kind of fluid to be discharged. A body 2 and the like other than these components also are not limited in shape, material and the like to said embodiments, but may be others in shape, material and the like.

What is claimed is:

1. A fluid discharging device comprising a pump member, a valve member, a suction passage and an outlet capable of communicating with a measuring space to be closed by the pump member and the valve member, wherein;

said valve member is provided with said outlet and is provided so as to be movable forward and backward in the axial direction of the outlet relative to the pump member, and this valve member is provided with a suction passage opening and closing portion capable of closing or opening said suction passage by being attached to or detached from said pump member with the forward or backward movement of it, and said pump member is provided with an outlet opening and closing portion capable of closing or opening the outlet by being attached to or detached from the outlet of the valve member and a measuring portion which is arranged in the shape of a concentric circle outside this outlet opening and closing portion and is capable of changing the volume of a measuring space by being moved forward and backward relative to said measuring space; and said fluid discharging device is provided with;

an outlet opening and closing means for closing and opening the outlet by moving said outlet opening and closing portion forward and backward relative to the outlet, and can open the suction passage by detaching the suction passage opening and closing portion of the valve member from the pump member through energizing said valve member away from the pump member, a measuring portion moving means which is arranged in the shape of a concentric circle outside the outlet opening and closing means and can change the volume of the measuring space by moving said measuring portion forward and backward relative to the valve member, an energizing means for closing the suction passage by pressing said suction passage opening and closing portion against the pump member through energizing said valve member toward the pump member, and a driving means for driving said outlet opening and closing means and said measuring portion moving means respectively in their specified action manners.

2. A fluid discharging device according to claim 1, wherein;

said pump member is formed out of a diaphragm wherein the peripheral portion of the diaphragm is thicker than the central portion of the diaphragm, the central portion is formed into a thin film, an outlet opening and closing portion is formed, the thin film center and a measuring portion is formed around the circumference of the opening and closing portion, and a flat seal portion, against which the outlet opening and closing portion of said valve member is pressed, is formed on said thicker peripheral portion of the pump member, and said valve member is formed into one body with a diaphragm wherein the central portion of the diaphragm is thicker than the peripheral portion of the diaphragm, the peripheral portion is formed into a thin film, the valve member is fixed immovably to said pump member in its peripheral portion, and an outlet is formed in said thick central portion being continuous to this peripheral portion through the thin film, and this thick part is made movable forward and backward relative to said pump member by deformation of said thin film part.

3. A fluid discharging device according to claim 2, wherein the central portion thin film of the pump member comprises a thicker outlet opening and closing portion and a thinner thin film part, and said measuring portion is formed by bending the thin film part.

4. A fluid discharging device according to claim 2, wherein;

the outlet opening and closing portion and the flat seal portion of said pump member, and the outlet opening and closing portion of said valve member and an opening end face part of the outlet against which said outlet opening and closing portion is pressed are finished by lapping.

5. A fluid discharging device according to claim 1, wherein;

said driving means is composed to drive said outlet opening and closing means and said diaphragm moving means is composed so as to perform;

a sucking operation of, in a state where the outlet is closed by pressing said outlet opening and closing portion against the valve member, sucking fluid by opening the suction passage by detaching the suction passage opening and closing portion of the valve member from the pump member and making the measuring space larger in volume by moving the measuring portion of the pump member away from the valve member, a measuring operation of measuring the fluid to be discharged by, after this sucking operation, closing the suction passage through pressing the suction passage opening and closing portion of the valve member against the pump member, and a discharging operation of discharging the fluid by, after said measuring operation, opening the outlet by detaching the outlet opening and closing portion of the pump member from the outlet and moving the measuring portion of the pump member so as to become close to the valve member.

* * * * *